US006973677B2

(12) United States Patent
Diaz et al.

(10) Patent No.: US 6,973,677 B2
(45) **Date of Patent: *Dec. 13, 2005**

(54) AIR FILTRATION SYSTEM INCLUDING A HELMET ASSEMBLY

(75) Inventors: Luis A. Diaz, Yabucoa, PR (US); Bruce D. Henniges, Kalamazoo, MI (US); Mark A. Wasserman, Delton, MI (US); Karen L. Smit, Kalamazoo, MI (US)

(73) Assignee: Stryker Instruments, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/008,313

(22) Filed: Dec. 9, 2004

(65) Prior Publication Data

US 2005/0109337 A1 May 26, 2005

Related U.S. Application Data

(60) Division of application No. 10/625,309, filed on Jul. 23, 2003, which is a continuation of application No. 10/188,656, filed on Jul. 2, 2002, now Pat. No. 6,622,311, which is a continuation of application No. 09/764,697, filed on Jan. 18, 2001, now Pat. No. 6,481,019.

(60) Provisional application No. 60/176,958, filed on Jan. 18, 2000.

(51) Int. Cl.[7] ..... A42C 5/04
(52) U.S. Cl. ..... 2/171.3; 128/201.19
(58) Field of Search ..... 2/171.3, DIG. 1, 2/416, 417, 418, 419, 420, 421, 424, 901, 2/84, 456, 63, 51, 114, 202, 205, 457; 128/201.19, 128/201.22, 201.23, 201.24, 201.25, 202.19, 128/202.22, 202.27, 200.28

(56) References Cited

U.S. PATENT DOCUMENTS

| | | | | |
|---|---|---|---|---|
| 1,037,206 | A | | 9/1912 | Clifford |
| 1,766,272 | A | | 6/1930 | Vallier |
| 2,739,310 | A | * | 3/1956 | Frieder et al. ..... 2/418 |
| 3,018,776 | A | | 1/1962 | Saitta et al. |
| 3,025,525 | A | | 3/1962 | Larson |
| 3,048,776 | A | | 8/1962 | Logan |
| 3,058,463 | A | | 10/1962 | Goodrich, Jr. |
| 3,214,809 | A | | 11/1965 | Edwards |
| 3,529,594 | A | | 9/1970 | Charnely |
| 3,803,640 | A | | 4/1974 | Ericson |
| 3,822,698 | A | | 7/1974 | Guy |

(Continued)

FOREIGN PATENT DOCUMENTS

| | | |
|---|---|---|
| DE | 2600486 | 7/1976 |

(Continued)

*Primary Examiner*—Rodney M. Lindsey
(74) *Attorney, Agent, or Firm*—Howard & Howard

(57) ABSTRACT

An air filtration system and a helmet for use in the air filtration system are disclosed and utilized to filter air between a head and body of a user and an external environment. The air filtration system and helmet include inner and outer shells that define an air flow channel for channeling air about the user. A fan module is mounted between the inner and outer shells and a scroll housing is mounted adjacent the fan module. The scroll housing includes an air inlet for drawing air into the air filtration system and helmet, and at least one air outlet to distribute air flow to the air flow channel. The helmet includes air exits at front and rear sections that are in fluid communication with the air flow channel and the air outlet or outlets. The air filtration system includes a gown operating as a filter for filtering the air.

76 Claims, 10 Drawing Sheets

U.S. PATENT DOCUMENTS 3,881,198 A 5/1975 Waters
3,950,112 A 4/1976 Crump
3,955,570 A 5/1976 Hutter
4,019,508 A 4/1977 Der Estphanian
4,038,979 A 8/1977 McCosker
4,055,123 A 10/1977 Heidelberg
4,055,173 A 10/1977 Knab
4,133,308 A 1/1979 Lowe
4,136,688 A 1/1979 Gorman
4,280,491 A * 7/1981 Berg et al. ..... 128/201.24
4,296,746 A 10/1981 Mason, Jr.
4,320,256 A 3/1982 Freeman
4,336,799 A 6/1982 Almasi
4,469,097 A 9/1984 Kelman
4,549,541 A 10/1985 Sundahl
4,589,408 A 5/1986 Singer
4,590,951 A 5/1986 O'Connor
4,619,254 A 10/1986 Moretti
4,651,727 A 3/1987 Howorth
4,667,667 A 5/1987 Schnoor
4,672,968 A 6/1987 Lenox
4,674,492 A 6/1987 Niemeyer
4,676,236 A 6/1987 Piorkowski
4,711,033 A 12/1987 Mitchell
4,711,539 A 12/1987 Krusas et al.
4,730,612 A 3/1988 Dampney
4,864,654 A 9/1989 Schriver
4,875,477 A 10/1989 Waschkle
4,888,831 A * 12/1989 Oleson ..... 2/420
4,901,716 A 2/1990 Stackhouse
4,951,662 A 8/1990 Townsend
5,003,973 A 4/1991 Ford
5,009,225 A 4/1991 Vrabel
5,042,474 A 8/1991 Williamson
5,048,516 A 9/1991 Soderberg
5,054,479 A 10/1991 Yelland
5,054,480 A 10/1991 Bare
5,069,205 A 12/1991 Urso
5,088,117 A 2/1992 Fulmer
5,104,430 A 4/1992 Her-Mous
5,125,402 A 6/1992 Greenough
5,142,704 A 9/1992 Viermeister
5,142,706 A 9/1992 Layhon
5,237,707 A 8/1993 Lowrie
5,253,642 A 10/1993 Stackhouse
5,283,914 A * 2/1994 James ..... 2/424
5,342,121 A 8/1994 Koria
5,349,949 A 9/1994 Schegerin
5,373,588 A 12/1994 Hede
5,410,757 A 5/1995 Vienamo
5,452,712 A 9/1995 Richardson
5,492,116 A 2/1996 Scarberry
5,503,146 A 4/1996 Froehlich
5,515,843 A 5/1996 Chang
5,525,278 A 6/1996 Krosch
5,533,500 A * 7/1996 Her-Mou ..... 128/201.25
5,549,104 A 8/1996 Crump
5,553,500 A 9/1996 Grahn
5,564,124 A 10/1996 Elsherif
5,577,495 A 11/1996 Murphy
5,588,153 A 12/1996 Ignon
5,592,936 A 1/1997 Thomas
5,601,078 A 2/1997 Schaller
5,655,374 A 8/1997 Santilli
5,664,566 A 9/1997 McDonald
5,669,375 A 9/1997 Dahrendorf
5,682,618 A 11/1997 Johnson
5,687,713 A 11/1997 Bahr
5,690,095 A 11/1997 Glynn
5,711,033 A 1/1998 Green
5,720,281 A 2/1998 Allen
5,879,493 A 3/1999 Johnson
5,887,281 A 3/1999 Green
6,014,971 A 1/2000 Danisch
6,374,823 B1 4/2002 Hajianpour
6,393,617 B1 5/2002 Paris et al.

FOREIGN PATENT DOCUMENTS

GB 1574311 9/1980
GB 2183488 6/1987
WO WO 88/09193 12/1988
WO WO91/18569 12/1991

* cited by examiner 122
120
20
20
12
14
16
10

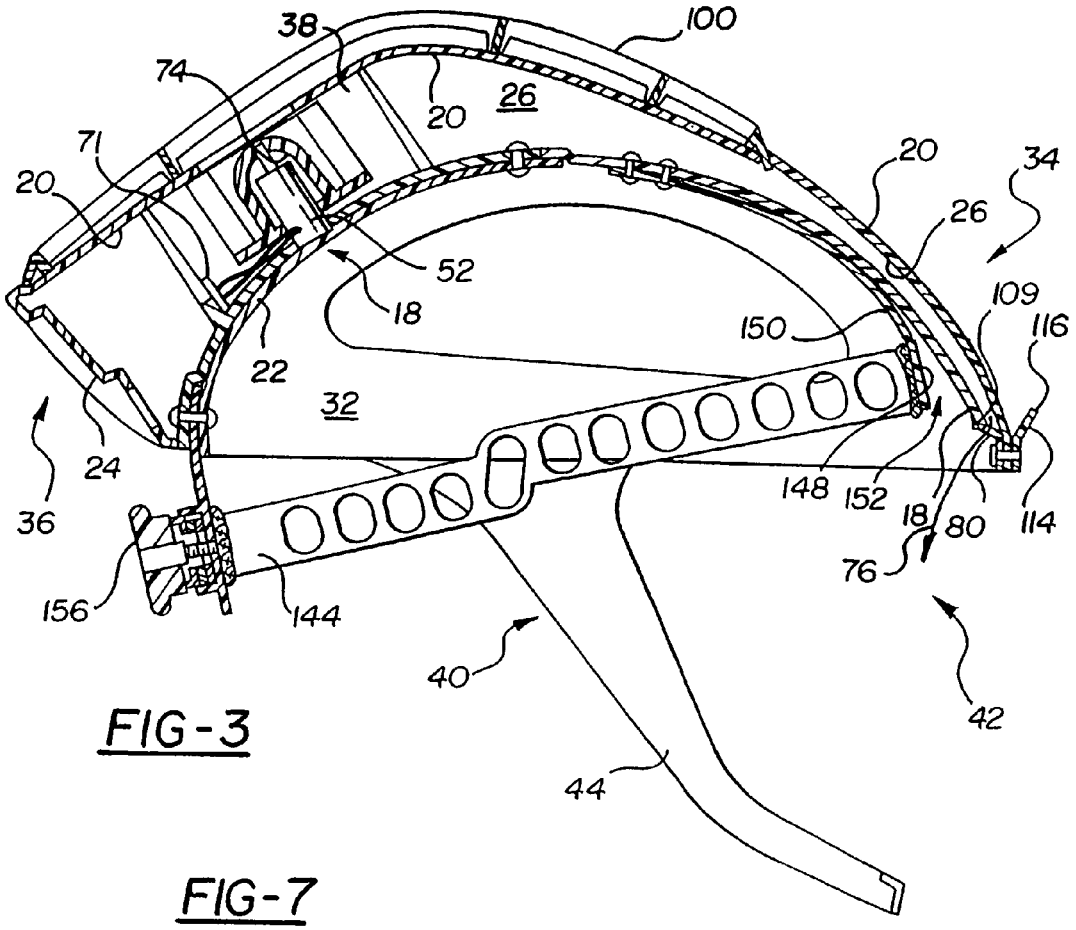
FIG-3
FIG-7
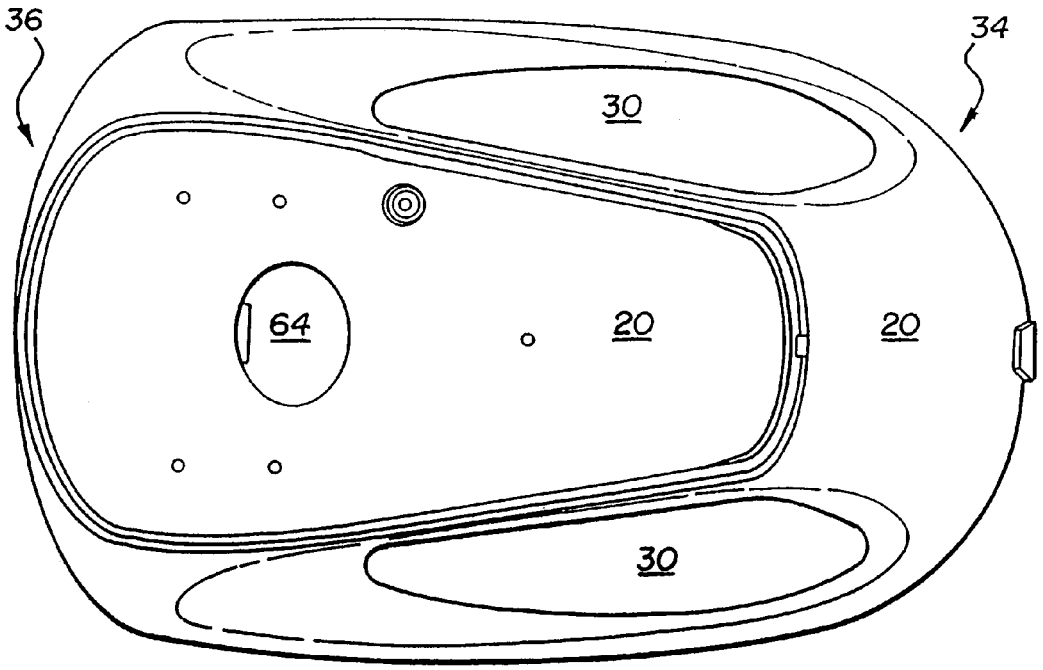

100
102
104
122
120
20
134
78
24
136
138
154
156
130

AIR FILTRATION SYSTEM INCLUDING A HELMET ASSEMBLY

RELATED APPLICATIONS

This patent application is a divisional of application Ser. No. 10/625,309, filed Jul. 23 2003, which is a continuation of application Ser. No. 10/188,656, filed Jul. 2, 2002, now U.S. Pat. No. 6,622,311, which is a continuation of application Ser. No. 09/764,697, filed Jan. 18, 2001, now U.S. Pat. No. 6,481,019, which claims priority to and all advantages of U.S. Provisional Patent Application No. 60/176,958 which was filed on Jan. 18, 2000.

BACKGROUND OF THE INVENTION

1) Technical Field

The subject invention generally relates to an air filtration system for filtering air between a head and body of a user and an environment external to the user. The air filtration system is utilized in the medical profession during surgical procedures. The subject invention more specifically relates to a helmet assembly and gown for use in the air filtration system.

2) Description of the Prior Art

Air filtration systems and helmet assemblies utilized in the air filtration systems are known in the art. As indicated above, air filtration systems and helmet assemblies are worn by users throughout the medical profession, such as surgeons, during surgical procedures for filtering air between a head and body of the surgeon and an external environment, such as a clean room.

Conventional air filtration systems and helmet assemblies are deficient for one reason or another. For example, U.S. Pat. No. 5,592,936 to Thomas, Jr. et al. discloses an air filtration system and helmet assembly that draws air through a filter medium into the helmet assembly and through an intake grid where the air is then channeled through an air flow channel over a face of the user. The air filtration system and helmet assembly of this patent are deficient in that air is not distributed completely about the head of the user. That is, air is not distributed to a back of the head, toward a neck, of the user. Further, the intake grid is deficient in that the grid does not extend between a front and rear section of the helmet assembly to maximize an effective intake area for the filter medium.

A further example of a conventional air filtration system and helmet assembly is disclosed in U.S. Pat. No. 5,054,480 to Bare et al. This patent discloses an air filtration system and helmet assembly that draws air into the helmet assembly via an intake fan, and exhausts air from the air filtration system and helmet assembly via an exhaust fan disposed at the rear section of the helmet assembly spaced away from the neck of the user. The air filtration system and helmet assembly of this patent is deficient in that they are overly heavy due to the additional fan required to exhaust air. Furthermore, the exhaust fan creates excessive strain, and therefore fatigue, in the neck of the user because the exhaust fan is spaced away from the neck of the user.

The conventional air filtration system and helmet assembly disclosed in U.S. Pat. No. 5,711,033 to Green et al. is also deficient. This patent discloses an air filtration system and helmet assembly that draws air into the helmet assembly through an intake fan and scroll housing disposed at a rear section of the helmet assembly. The air filtration and helmet assembly of this patent is deficient because the intake fan and scroll housing are spaced away from the neck of the user. Further, the scroll housing in this patent includes only one air outlet to distribute air about the head of the user resulting in less balanced air flow throughout the helmet assembly. Additional drawbacks of such an air filtration system and helmet assembly including only one air outlet from the scroll housing are excessive fog build-up and poorer heat dissipation in the helmet assembly.

Other conventional air filtration systems and helmet assemblies are also deficient for the following reasons. First, these conventional air filtration systems and helmet assemblies do not assist a single user in self-gowning as the surgeon maintains sterility. That is, these air filtration systems and helmet assemblies do not include a positioning and supporting system that automatically centers a face shield over the helmet assembly and that supports an entire weight of the gown and face shield. Instead, the conventional air filtration systems and helmet assemblies merely utilize hook-and-loop fasteners randomly places around the helmet assembly to connect the face shield to the helmet assembly in any orientation. Furthermore, randomly-placed hook-and-loop fasteners do not automatically center the face shield and do not support the entire weight of the gown and the face shield as the surgeon self-gowns. Instead, as the user self-gowns, he or she must repeatedly adjust the face shield in order to center the face shield. This is time consuming and burdensome.

Secondly, it is generally understood that the amount of air flowing into the helmet assembly is critical for anti-fogging and heat control purposes. However, the air filtration systems and helmet assemblies of the prior art do not assist the surgeon in recognizing the amount, or volume, of air flowing into the helmet assembly. That is, these air filtration systems and helmet assemblies do not provide audible indication to the surgeon of the volume of air flowing into the helmet assembly during any particular surgical procedure.

Thirdly, as discussed above, it is ideal to position and maintain any fans in the air filtration system and helmet assembly as directly over, and not spaced from, the neck of the user as possible in order to minimize strain and fatigue. The prior art air filtration systems and helmet assemblies do not incorporate a strap flexibly connected to the front section of the helmet assembly such that the strap is pulled from the front section of the helmet assembly and the weight of any fans is maintained over the user's neck when the helmet assembly is adjusted to fit various sized heads.

Due to the inefficiencies identified in such conventional air filtration systems and helmet assemblies, it is desirable to implement a novel air filtration system and helmet assembly that utilizes a single fan to distribute air toward both the face and the neck of the user and that includes a scroll housing that includes at least two air outlets for complete balancing of the air flow about the head of the user. It is also desirable to dispose the fan in the helmet assembly such that it is not spaced away from the neck of the user to minimize strain, and to include an intake grid that extends between front and rear sections of the helmet assembly to maximize the effective intake area for filtering the air. Finally, it is desirable to implement an air filtration system and helmet assembly that includes a positioning and supporting system to assist the user in self-gowning, that includes audible indication to the user of the volume of air flowing into the helmet, and that includes a strap that can be adjusted to fit different sizes of heads while maintaining the weight of the helmet assembly over the neck of the user.

SUMMARY OF THE INVENTION AND ADVANTAGES

An air filtration system for filtering air and a helmet assembly for use in the air filtration system is disclosed. The air filtration system and helmet assembly are utilized in the medical profession during surgical procedures to filter air between a head and body of a user, such as a surgeon, and an environment external to the user. As appreciated by those skilled in the art, the subject invention, in addition to air filtering, assists in controlling carbon dioxide concentration, dissipating heat, and anti-fogging within the helmet assembly. It is to be understood that the subject invention can also be utilized in other situations requiring filtered air including, but not limited to, the manufacturing of semi-conductor chips and other computer components in manufacturing clean rooms.

The air filtration system and helmet assembly include an inner structural shell and an outer structural shell. The outer structural shell extends from the inner structural shell to define at least one air flow channel between the inner and outer shells for channeling air about the head of the user. The helmet assembly further includes a base section and a facial section extending from the base section to define a facial opening.

A fan module is mounted to at least one of the inner and outer shells, and a scroll housing is mounted adjacent the fan module. More specifically, the fan module includes a fan and a motor, and the scroll housing includes at least one air inlet and at least one, preferably at least two, air outlets. The fan module, including both the fan and the motor, is disposed at the rear section of the base section. In operation, the fan module, specifically the fan, draws air into the air inlet and distributes air out of the scroll housing through the air outlet or outlets and into the air flow channel.

The subject invention also incorporates at least two helmet air exits, preferably a front and rear air helmet air exit for distributing air from the air flow channel toward the head of the user. More specifically, the front and rear air exits are disposed at the front and rear sections of the helmet assembly, respectively. The front and rear air exits are in fluid communication with the air flow channel and the air outlets. The front air exit distributes air from the air flow channel toward a front, or face, of the head of the user, and the rear air exit distributes air from the air flow channel toward a back, or neck, of the head of the user. As such, a single fan is utilized to distribute air toward both the face and the neck of the user. The air outlet or outlets of the scroll housing completely balance the air flow about the head of the user between the front and rear air exits. Further, because the fan is disposed at the rear section of the base section of the helmet assembly, the fan is not spaced away from the user's neck and strain and fatigue in the user is minimized.

The air filtration system further includes a gown having a body portion and a head portion. The body portion covers at least a portion of the body of the user and the head portion covers the base section of the helmet assembly. The head portion of the gown operates as a filter medium to filter air between the user and the external environment. The gown also includes a skirt. More specifically, the skirt is removably attached to the body portion of the gown exclusively at a front of the gown. An intake grid is mounted to the outer shell of the helmet assembly for user with the gown. The intake grid is contoured to the outer shell between the front section and the rear section of the base section to maximize an effective intake area for the filter medium to filter air drawn into the scroll housing.

The subject invention further includes a face shield mounted to the head portion of the gown to cover the facial opening. As such, the user can view through the head portion of the gown. Depending on the particular embodiment of the subject invention, the face shield includes either a mounting mechanism or a first visual indicator. These will be described further below.

Also depending on the particular embodiment, the base section of the helmet assembly includes either a mounting device or a second visual indicator positioned, preferably centered, relative to the facial opening. If the helmet assembly includes the mounting device, the mounting device interlocks with the mounting mechanism on the face shield. As such, the subject invention provides a positioning and supporting system that automatically centers the face shield over the facial opening and that preferably supports the entire weight of the gown in order to assist the single user in self-gowning as the user maintains sterility. On the other hand, if the helmet assembly includes the second visual indicator, then the second visual indicator aligns with the first visual indicator on the face shield. As such, the subject invention provides a visual positioning system that automatically centers the face shield over the facial opening thereby assisting the single user is self-gowning as the user maintains sterility.

The subject invention also includes a controller that operates with a power supply to control the amount, or volume, of air into the air filtration system and helmet assembly and to provide audible indication of the volume of air to the user while the user is wearing the air filtration system and helmet assembly during the surgical procedure. Preferably, the power is integrally disposed within the helmet assembly. The air filtration system and helmet assembly of the subject invention also include a strap flexibly connected to the helmet assembly such that the strap is pulled from the front section of the helmet assembly. As a result, the weight of the fan is maintained over the user's neck when the helmet assembly is adjusted to fit various sized heads.

The subject invention further includes a method for maintaining a constant volume of air flowing into an air filtration system during the entire use of the air filtration system. The method includes the steps of selectively activating and deactivating the power supply at a first activation rate to distribute a required voltage to the motor. This step establishes a rotational speed for the fan that correlates to the constant volume of air flowing into the air filtration system. Next, the method monitors the back electromotive force of the motor of the helmet assembly to determine the rotational speed of the fan as well as when the rotational speed of the fan has stabilized for some predetermined period of time. The voltage of the power supply is monitored after the rotational speed of the fan has stabilized for the predetermined period of time. Finally, the power supply is selectively activated and deactivated at a second activation rate as the monitored voltage of the power supply decreases. This step sustains the required voltage that is distributed to the motor such that the constant volume of air flowing into the air filtration system is maintained throughout the entire use of the air filtration system.

Accordingly, the subject invention provides an air filtration system and helmet assembly that overcomes the deficiencies in the prior art as identified above.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a partially cross-sectional side view illustrating a base section and a facial section of the helmet assembly and an air flow channel and air exits within the helmet assembly;

FIG. 7 is a top view of the helmet assembly;

DETAILED DESCRIPTION OF THE PREFERRED EMBODIMENT

Figure 1:
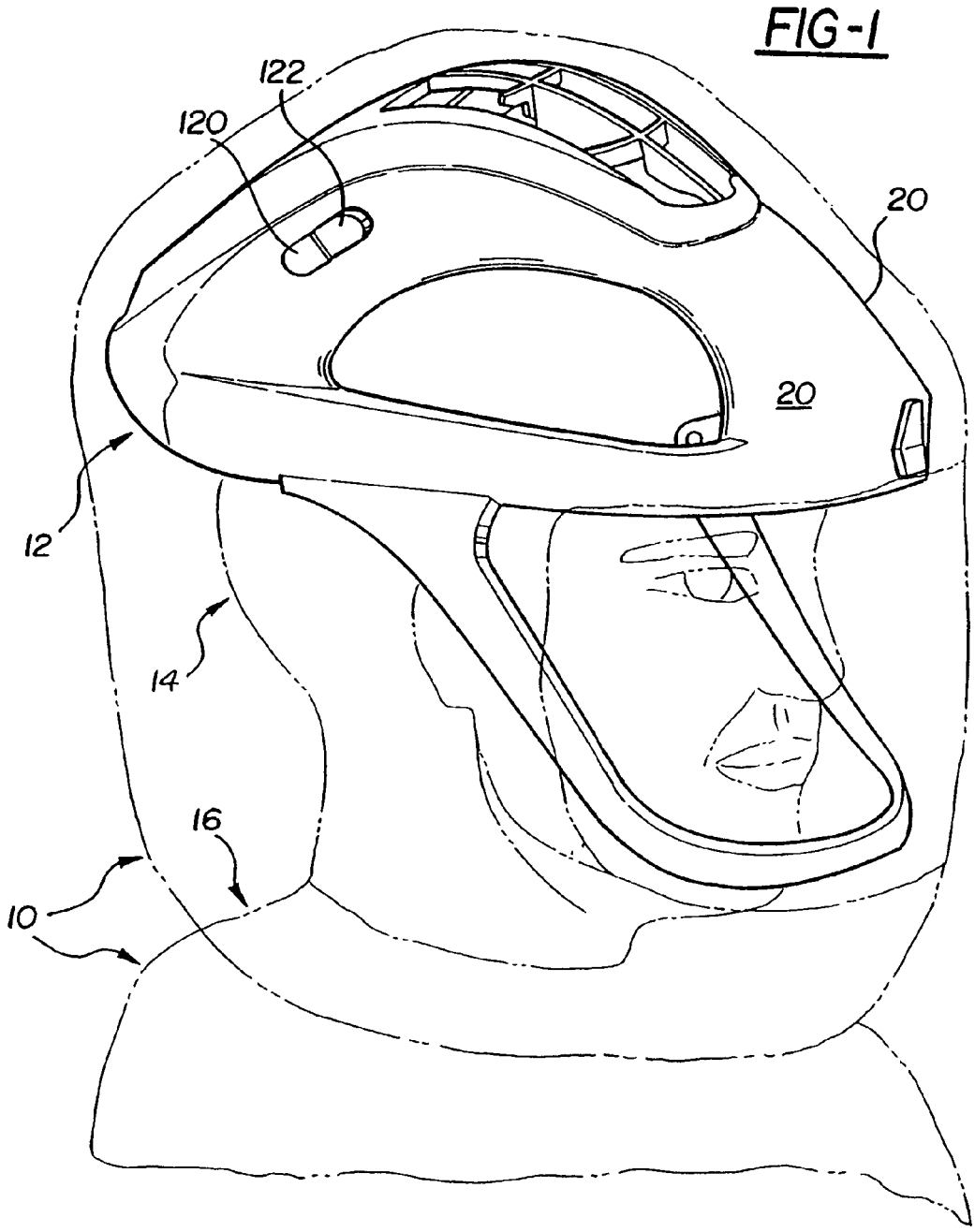
FIG. 1 is a perspective view of a helmet assembly mounted on a head of a user of the assembly.

Referring to the Figures, wherein like numerals indicate like or corresponding parts throughout the several views, an air filtration system and helmet assembly are generally disclosed at 10 and 12, respectively. Referring to FIG. 1, the air filtration system 10 filters air between a head 14 and body 16 of a user and an environment external to the user and includes the helmet assembly 12 mounted to the head 14 of a user. The helmet assembly 12 distributes air about the head 14 of the user as will be described below. More specifically, the helmet assembly 12 distributes air toward both a front of the head 14, i.e., the face, of the user, and a back of the head 14, i.e., the neck, of the user.

Figure 2:
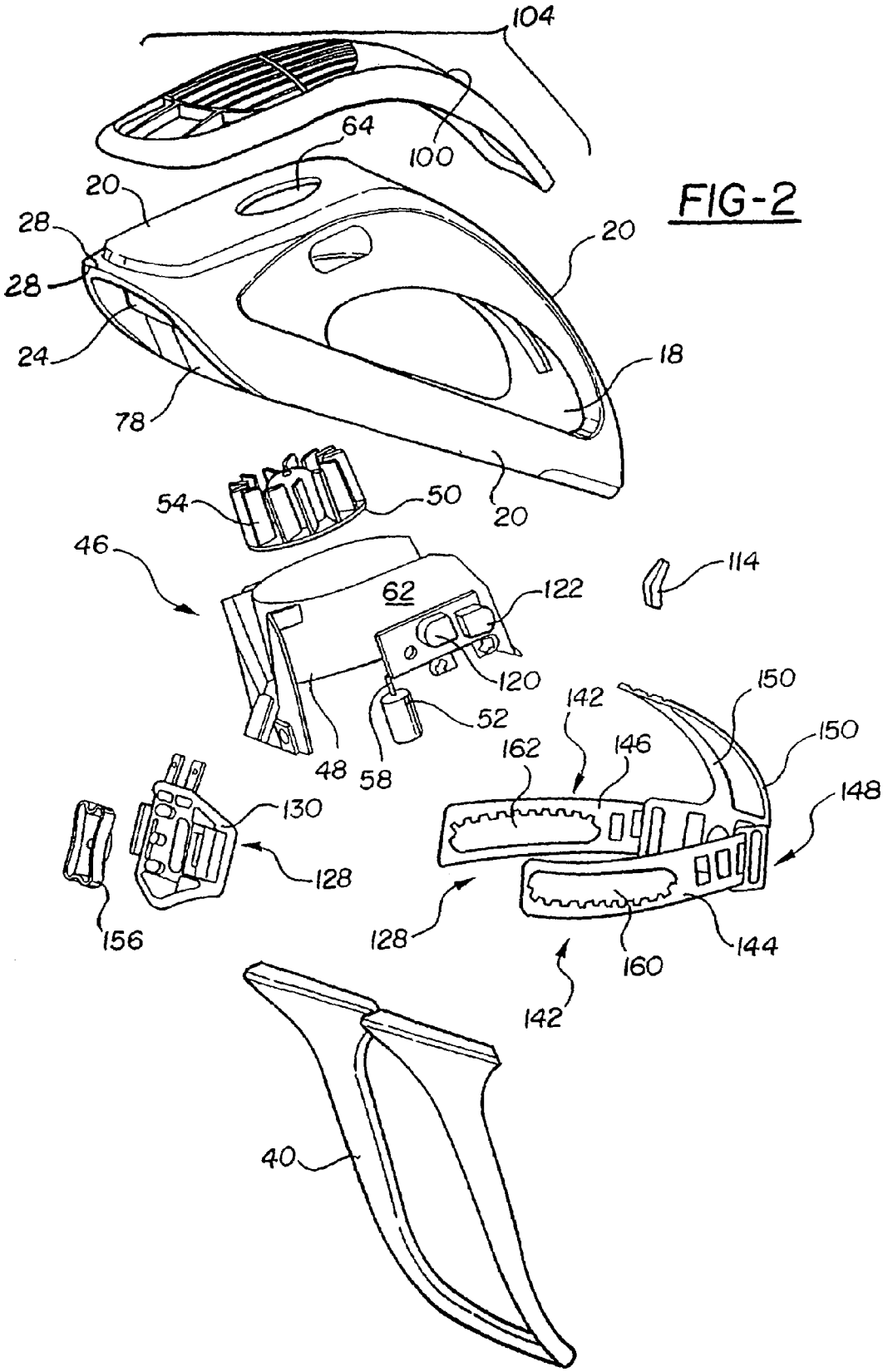
FIG. 2 is an exploded perspective view of the helmet assembly.

Referring now to FIGS. 2 and 3, the helmet assembly 12 includes an inner structural shell 18 and an outer structural shell 20. The inner shell 18 includes a cover surface 22 and a rear facing 24 which extend to the outer shell 20. The cover surface 22 and rear facing 24 will be discussed further below. The outer shell 20 is spaced apart from the inner shell 18 and extends from the inner shell 18 to define at least one air flow channel 26 between the inner and outer shells 18, 20. It is to be understood that the subject invention may include more than one discrete air flow channel 26. However, the preferred embodiment includes a single unitary air flow channel 26 and the subject invention will be described below in terms of this air flow channel 26.

The air flow channel 26 channels air about the head 14 of the user. The inner and outer shells 18, 20 form the air flow channel 26 from a two-sheet thermoforming process which improves the structural strength of the inner and outer shells 18, 20. More specifically, each of the inner and outer shells 18, 20 include an outer periphery 28, and in the two-sheet thermoforming process, the inner and outer shells 18, 20 are pinched together at their outer peripheries 28. The air flow channel 26 is subsequently thermoformed between the pinched outer peripheries 28. As shown best in FIG. 7, dissipation cavities 30 are disposed at opposite lateral sides of the inner and outer shells 18, 20 to provide for increased air release from the air flow channel 26 and from the user out through the helmet assembly 12.

The helmet assembly 12 further includes a base section 32 having a front section 34 and a rear section 36. The inner and outer shells 18, 20 extend between the front and rear sections 34, 36 to define the air flow channel 26. The cover surface 22 and the rear facing 24 of the inner shell 18 extend to the outer shell 20 at the rear section 36 of the base section 32. Also, at the rear section 36 of the base section 32, a mounting cavity 38 is formed between the cover surface 22 of the inner shell 18 and the outer shell 20. The mounting cavity 38 will be discussed further below. The inner and outer shells 18, 20 form the base section 32. It is understood that the base section 32 is the portion of the helmet assembly 12 that is mounted over the head 14 of the user. As such, it is also understood that the front section 34 of the base section 32 is at the face of the user as the user wears the helmet assembly 12, and the rear section 36 of the base section 32 is at the neck of the user as the user wears the helmet assembly 12.

The helmet assembly 12 also includes a facial section 40 extending from the base section 32 to define a facial opening 42. The facial section 40 of the helmet assembly 12 is a chin bar 44. Preferably, the chin bar 44 is flexible and is formed of plastic. The chin bar may also be formed of a polypropylene component. The flexibility of the chin bar 44 protects the user's face and also absorbs impact when the user contacts an external object with the helmet assembly 12.

Referring to FIGS. 2 through 6, the air filtration system 10 and helmet assembly 12 further include a fan module 46 mounted to at least one of the inner and outer shells 18, 20 and a scroll housing 48 mounted in the helmet assembly 12 adjacent the fan module 46. More specifically, both the fan module 46 and the scroll housing 48 are disposed within the mounting cavity 38 at the rear section 36 of the helmet assembly 12. Disposing the fan module 46 and the scroll housing 48 in the mounting cavity 38 is space-saving, reduces the overall weight of the helmet assembly 12 because additional mounting connections are not required, and minimizes strain and fatigue on the head 14 and the neck of the user.

The fan module 46 includes a fan 50 and a motor 52 and is disposed at the rear section 36 of the base section 32. The fan 50 includes a plurality of curved blades 54 and a hub portion 56. The curved blades 54 of the fan 50 encourage air into the scroll housing 48. The motor 52 includes an output 58, or drive shaft, that is operatively connected to the fan 50 to drive the fan 50 at a plurality of rotational speeds correlating to an amount, or a volume, of air flowing into the air flow channel 26. As appreciated, the rotational speeds of the fan 50 can be measured in revolutions per minute (RPMs).

Figure 4:
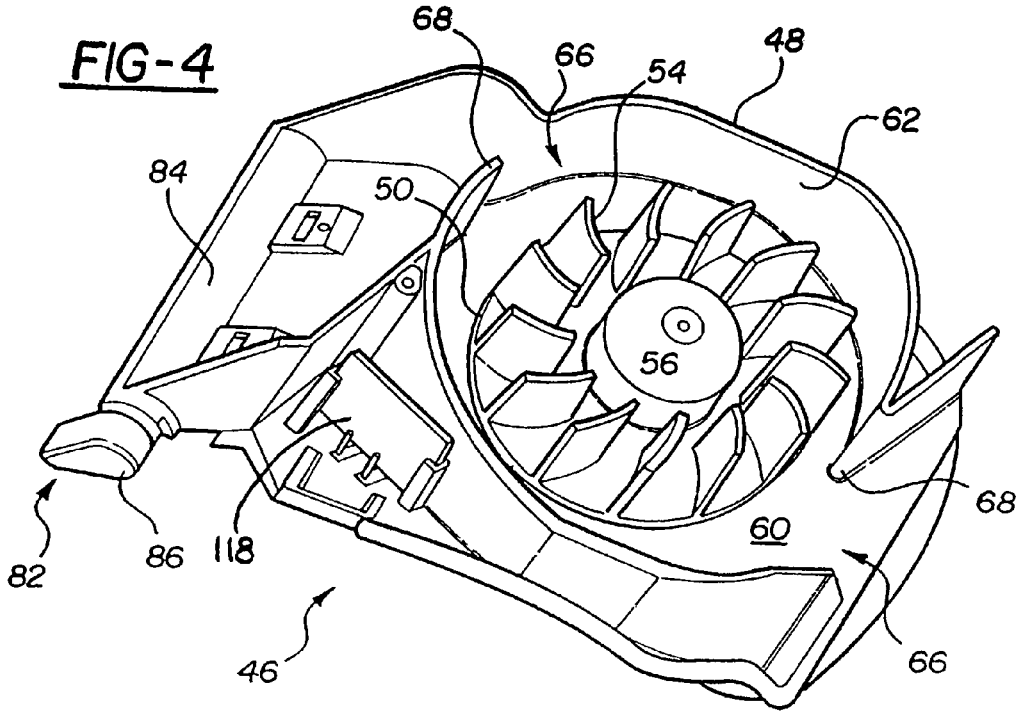
FIG. 4 is a perspective view of a fan module and scroll housing of the subject invention including at least one air outlet from the scroll housing.
Figure 5:
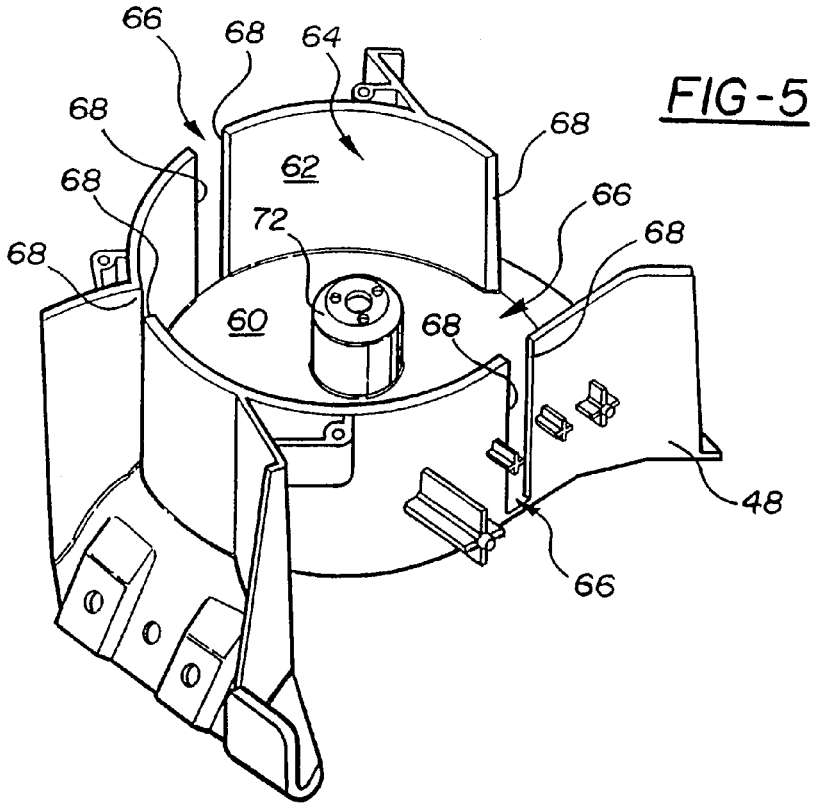
FIG. 5 is a perspective view of the scroll housing including more than one air outlet from the scroll housing.

Referring primarily to FIGS. 4 and 5, the scroll housing 48 includes a base portion 60 and an outer wall 62 circumferentially extending around the base portion 60. The scroll housing 48 further includes at least one air inlet 64 and at least one air outlet 66. In the most preferred embodiment of the subject invention, the scroll housing includes a plurality of air outlets 66. That is, in this embodiment the scroll housing includes at least two air outlets 66. Other specific embodiments of the subject invention may also only include the fan module 46 without the scroll housing 48. In such embodiments, the at least one air inlet and the at least one air outlet can be described as components of the fan module 46.

Figure 8:
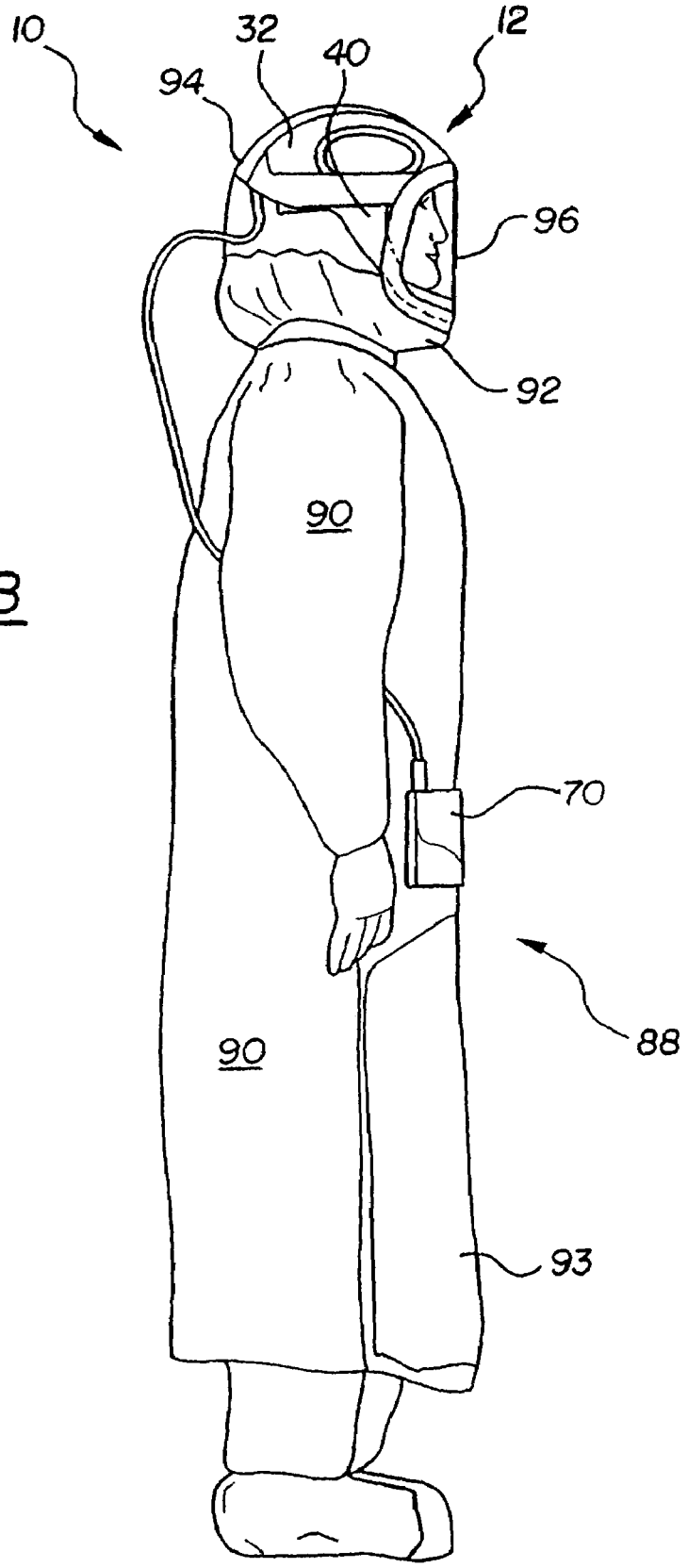
FIG. 8 is a side view of the helmet assembly and an air filtration system including a gown and face shield.

In operation, the motor 52 rotates the fan 50 to draw air into the air inlet 64 of the scroll housing 48 and distributes air out of the scroll housing 48 through the air outlet 66 or outlets 66 and into the air flow channel 26 where the air is distributed about the head 14 of the user. The scroll housing 48 also includes at least one air flow cutoff 68 which cuts the air as the fan 50 moves the air within the scroll housing 48. More specifically, as shown in the Figures, the subject invention incorporates several air flow cutoffs 68 in the scroll housing 48 to cut the air. A power supply 70 is incorporated in the subject invention to power the motor 52 to rotate the fan 50 via the motor output 58. Preferably, the power supply 70 is a rechargeable DC battery. Also preferred, the power supply 70 is disposed within, i.e., integrated into, the helmet assembly 12. In such a case, the power supply 70 is referred to as an integral power supply 71 as shown in FIG. 3. Alternatively, the power supply 70 can be mounted to the body 16 of the user as shown in FIG. 8. The power supply 70 powers the motor 52 through pulse width modulation (PWM) which will be discussed further below. The design of the scroll housing 48 provides more efficient movement of air with less power being required from the power supply 70 overall. Furthermore, in addition to such reduced power requirements, the scroll housing 48 provides that sufficient air flow can be maintained with overall less air velocity. This results in a more quiet helmet assembly 12.

Figure 6:
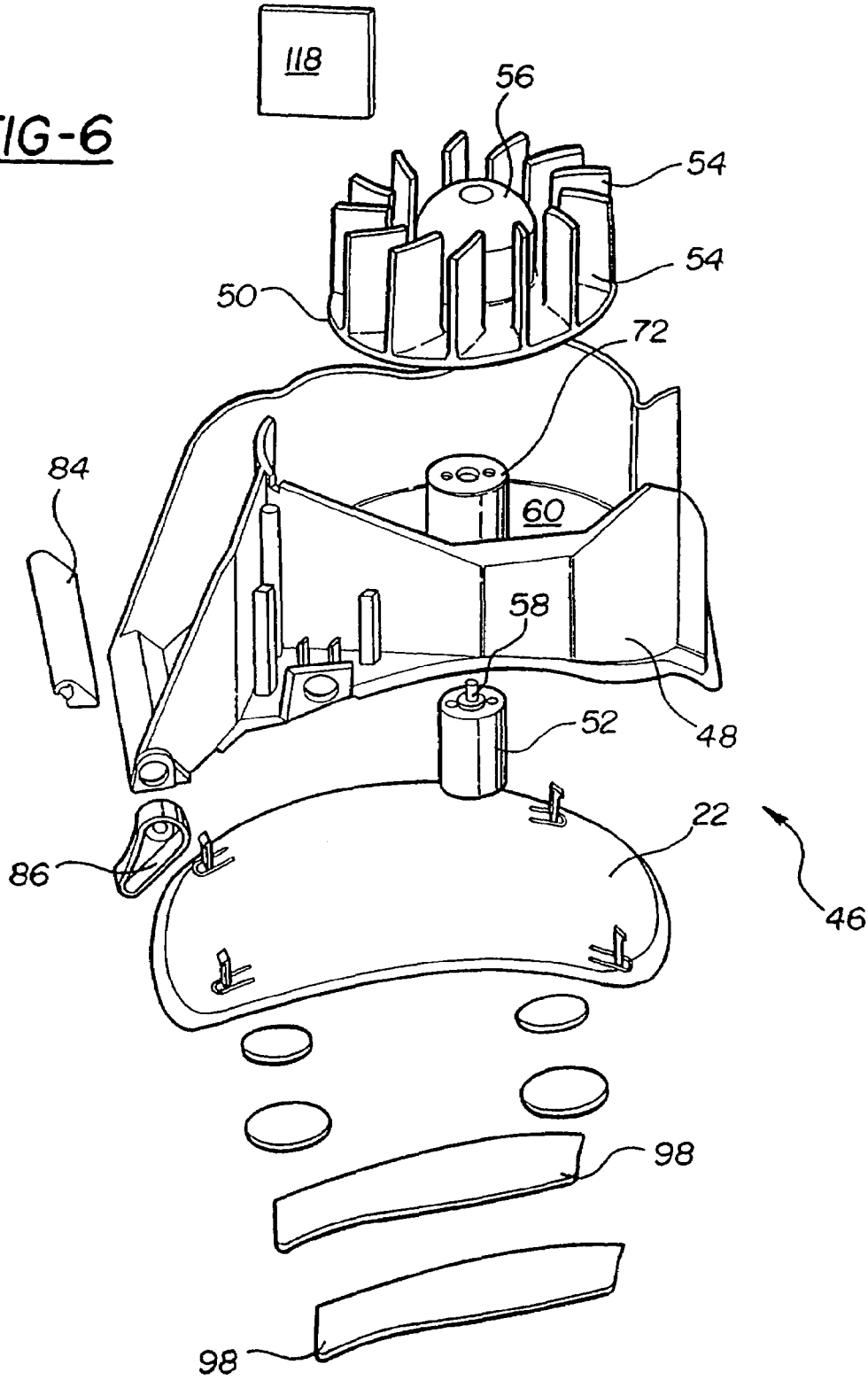
FIG. 6 is an exploded view of the fan module and scroll housing.

More specifically, the fan 50 of the fan module 46 is rotatably mounted to the base portion 60 of the scroll housing 48 within the outer wall 62 of the scroll housing 48 to draw air into the air inlet 64. As best shown in FIGS. 2 and 7, the air inlet 64 of the scroll housing 48 is integrally formed within the outer shell 20 of the helmet assembly 12 for drawing air into the scroll housing 48. However, it is to be understood that the air inlet 64 is not required to be integrally formed within the outer shell 20 of the helmet assembly 12. That is, in an alternative embodiment of the subject invention, an external structure, not shown in the Figures, can be mounted external to the helmet assembly 12 to establish the air inlet 64 of the scroll housing 48 for drawing air into the scroll housing 48. Referring now to FIGS. 4 through 6, the scroll housing 48 further includes a support pedestal 72 protruding from the base portion 60. As shown in the Figures, the support pedestal 72 is integrally formed as a part of the scroll housing 48 to protrude from the base portion 60. Alternatively, it is also to be understood that the support pedestal 72 can be a separate part. That is, the support pedestal 72 can be a separate part that is mounted or connected to the base portion 60 of the scroll housing 48 via connecting screws, snap-fit, and the like. The hub portion 56 of the fan 50 is rotatably mounted in the scroll housing 48 on the support pedestal 72 by screws or other fasteners. The motor 52 of the fan module 46 is mounted within an underside 74 of the support pedestal 72 between the support pedestal 72 and the cover surface 22 of the inner shell 18 for space-saving purposes in the helmet assembly 12. As appreciated, the underside 74 of the support pedestal 72 is essentially hollow. The cover surface 22 of the inner shell 18 operates as a motor cover to close the fan module 46 at the inner shell 18.

With respect to the at least two air outlets 66, the outer wall 62 of the scroll housing 48 is partitioned to define the air outlets 66. In the particular embodiment of the subject invention having the at least two air outlets 66, it is to be understood that the subject invention is not limited to at least two air outlets 66. That is, the subject invention may include, for example, three or four air outlets 66. The air outlets 66 provide a complete balance of air as the air is distributed from the scroll housing 48 about the head 14 of the user. To accomplish this, the helmet assembly 12 includes at least two helmet air exits 76, 78. The air outlets 66 are in fluid communication with the at least two helmet air exits 76, 78 to distribute the air from the outlets 66, which is in the air flow channel, toward the head of the user. In the embodiments of the subject invention where the helmet assembly includes the at least two helmet air exits 76, 78 it is not critical that the scroll housing 48 include at least two air outlets 66. To the contrary, the scroll housing, in these embodiments, may only have at least one air outlet 66.

Preferably, the first 76 and second 78 air exits are respectively front and rear air exits in that they are disposed at the front and rear sections 34, 36 of the helmet assembly 12, respectively, to effectively distribute air toward both the face and neck of the user. However, in alternative embodiments, the first and second air exits 76, 78 can be customized to distribute air toward any portion of the user's head. For instance, the first and second air exits 76, 78 can be side air exits such that air is distributed toward the side of the user's head. For descriptive purposes only, the subject invention will be described below only in terms of the front 76 and rear 78 air exits and will be numbered accordingly. More specifically, the front air exit 76 is disposed at the front section 34 of the base section 32 for distributing air from the air flow channel 26 toward the front of the head 14 of the user, and the rear air exit 78 is disposed at the rear section 36 of the base section 32 for distributing air from the air flow channel 26 toward the back of the head 14 of the user. The rear air exit 78 is formed within the rear facing 24 for distributing air from the air flow channel 26 toward the back of the head 14 of the user.

As shown in FIG. 3, the air flow channel 26 defined between the inner and outer shells 18, 20 terminates at the front section 34 with the front air exit 76 and at the rear section 36 with the rear air exit 78. More specifically, the inner and outer shells 18, 20 converge toward the front section 34 of the base section 32 to define the front air exit 76. The front air exit 76 has an air deflection angle 80. The air deflection angle 80 is defined between the outer shell 20 and the inner shell 18 wherein the outer shell 20 angles toward the inner shell 18 at the front air exit 76 for proper deflection of air toward the front of the head 14 of the user. As appreciated, the air deflection angle 80 between the outer 20 and inner 18 shell is greater than zero, preferably between 25–35 degrees. Additionally, referring to FIG. 7, the air flow channel 26 diverges outwardly upon approaching the front air exit 76. The convergence and divergence of the air flow channel 26 maintains a balanced flow of air about the user's head 14. Ultimately, this also has the effect of minimizing or even completely eliminating noise within the helmet assembly 12 due to the air flow.

As shown in FIG. 4, the subject invention incorporates at least one air bleed valve 82 in the scroll housing 48 to influence the amount, or the volume, of air flowing into the air flow channel 26 from each of the air outlets 66. It is to be understood that, although there is only one air bleed valve 82 shown in FIG. 4, the subject invention may alternatively incorporate more than one air bleed valve. The air bleed valve 82 influences the volume of air flowing to the rear air exit 78 thereby affecting the volume of air flowing to the rear air exit 78 that is distributed primarily toward the back of the head 14 of the user. To accomplish this, the air bleed valve 82 includes a blade 84 that can be rotated to cover, i.e., close, the air outlet 66 of the scroll housing 48 nearest the rear air exit 78. If covered or closed, more air is moved to the front air exit 76 of the helmet assembly 12 and the volume of air flowing is constant, not variable. As shown in the Figures, the air bleed valve 82 is mechanically controlled by a mechanical lever or knob 86 in order to manipulate the volume of air flowing into the air flow channel 26 from each of the air outlets 66. However, the air bleed valve 82 may alternatively be electronically controlled to manipulate the volume of air. Also, it is to be understood that the air bleed valve 82 is not required in the subject invention.

Referring to FIG. 8, the air filtration system 10 includes a gown 88 having a body portion 90 for covering at least a portion of the body 16 of the user and a head portion, or hood, 92 for covering the base section 32 of the helmet assembly 12, which houses the head 14 of the user. More specifically, the body portion 90 can extend downward to cover any portion of the body 16 of the user. For instance, the body portion 90 can extend downward to the shoulders of the user, or to the waist of the user, or to the ankles of the user. The head portion 92 of the gown 88 operates as a filter medium 94 to filter air between the user and the external environment. A skirt 93 is attached to the body portion 90 of the gown 88 exclusively at a front, not numbered, of the gown 88. Because the skirt 93, which is typically sterile in the industry, is only attached at the front, i.e., does not encircle around a back of the gown 88, cost can be saved. Also, the skirt 93 is removably attached at the front of the body portion 90 of the gown 88 such that a particular user can decide whether to use the skirt 93 or not. The skirt 93 is attached to the gown 88 in any known manner in the industry including, but not limited to, adhesive tape. The facial section 40 of the helmet assembly 12, introduced above, also operates to maintain the gown 88 away from the head 14 of the user.

Figure 9:
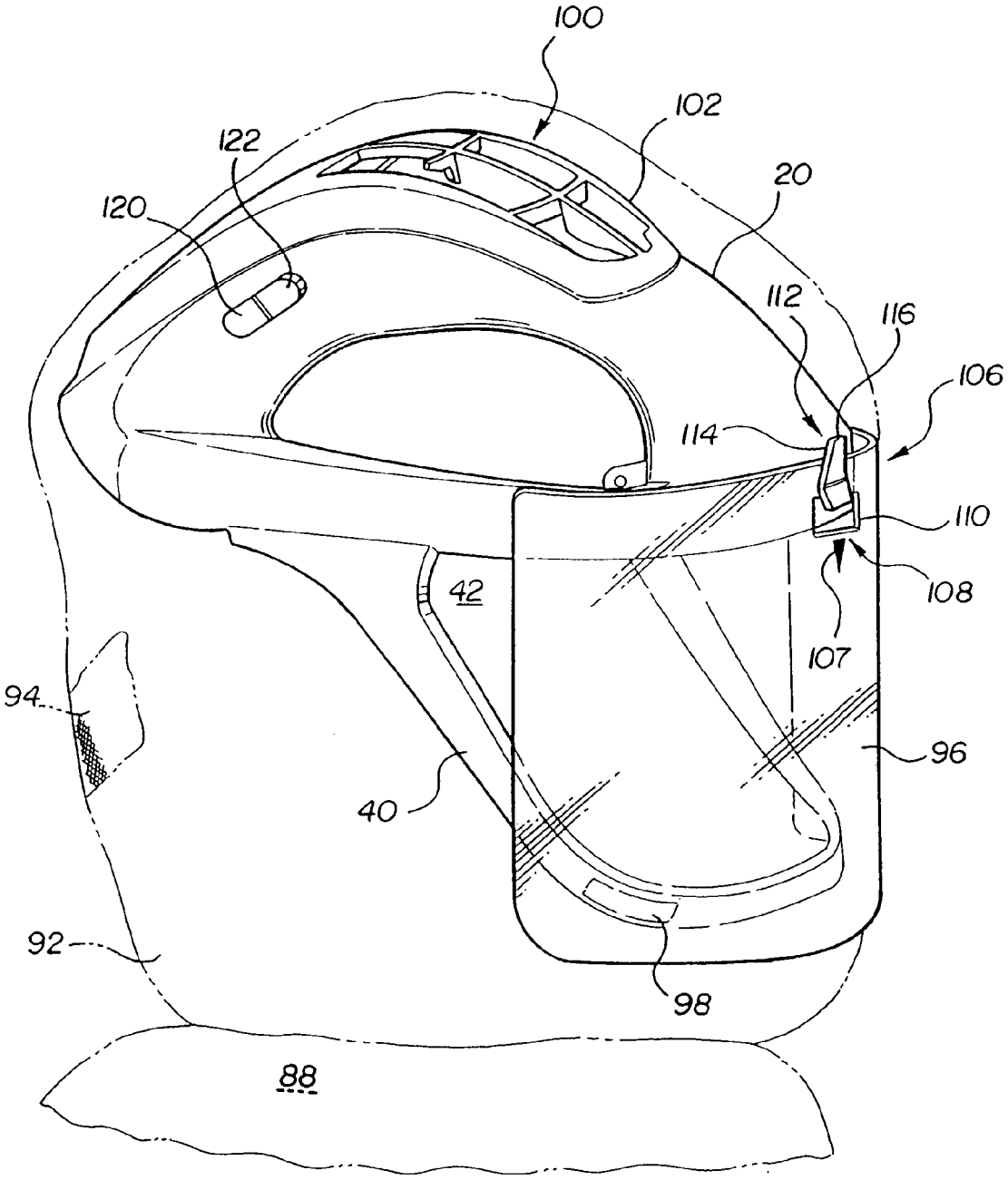
FIG. 9 is a perspective view of the helmet assembly illustration a positioning and supporting system including a mounting clip supporting the face shield via an aperture in the face shield.

The subject invention also includes a face shield 96 that permits the user to view through the head portion 92 of the gown 88 and the facial opening 42 of the helmet assembly 12. As shown in FIG. 9, the face shield 96 is mounted to the head portion 92 of the gown 88 such that the face shield 96 covers the facial section 40 and the facial opening 42 of the helmet assembly 12 once the user dresses into the air filtration system 10. More specifically, the face shield 96 is sewn into the head portion 92 of the gown 88 to maintain a complete barrier between the user and the external environment. The facial opening 42 of the helmet assembly 12 essentially receives the face shield 96. Preferably, the facial section 40 of the helmet assembly 12 includes a hook-and-loop fastener 98 to further facilitate attachment of the face shield 96 to the facial section 40 for covering the facial opening 42.

The helmet assembly 12 further includes an intake grid 100 mounted to the outer shell 20. The intake grid 100 includes a top surface 102 spaced from the outer shell 20 of the helmet assembly 12 to retain the filter medium 94 away from the outer shell 20 and the fan 50. Furthermore, the intake grid 100 is contoured to the outer shell 20 between the front section 34 and the rear section 36 of the base section 32. This improves the effective seal between the gown 88 and the helmet assembly 12, and maximizes an effective intake area 104 for the filter medium 94 to filter air drawn into the scroll housing 48 by the fan 50.

Referring now to FIG. 9, the subject invention also includes a positioning and supporting system 106 for assisting a single user in self-gowning as the user maintains sterility. As understood by those skilled in the art, users 'dress into' the air filtration system 10 and helmet assembly 12 first by mounting the helmet assembly 12 on their head 14. The gown 88, which includes an interior and an exterior, is classified as not sterile on the interior, and sterile on the exterior. As such, the user places their arms partially into sleeves of the gown 88 and then, with their arms partially in the sleeves, uses the sleeves of the gown 88 to grasp the head portion 92, including the face shield 96, and bring the head portion 92 over the helmet assembly 12 and the head 14 of the user. It is understood that the user then attempts to center the face shield 96 relative to the facial section 40 and facial opening 42 of the helmet assembly 12. As discussed above, in the prior art the user must repeatedly adjust the face shield 96 in order to center the face shield 96. It is understood that this is burdensome because the user has their hands partially in the sleeves of the gown 88. Furthermore, in the prior art, sterility of the user is sometimes compromised. Once centered, the user extends their arms entirely through the sleeves of the gown 88, and an assistant, such as a nurse, places sterile gloves on hands of the user.

As the head portion, or hood, 92 of the gown 88 is brought over the helmet assembly 12, the subject invention, to assist the user in gowning without a need for outside assistance while maintaining sterility, utilizes a mounting mechanism 108. Although not required, which will be discussed below, the mounting mechanism 108 is preferably centered on the face shield 96. The mounting mechanism 108 supports the face shield 96 on the helmet assembly 12. Preferably, the mounting mechanism 108 is an aperture 110 formed within the face shield 96. The function of the mounting mechanism 108, the aperture 110, will be described further below.

The subject invention also utilizes a mounting device 112 included on the base section 32 of the helmet assembly 12. More specifically, the mounting device 112 is positioned on the helmet assembly 12 relative to the facial opening 42. Although not required, which will be discussed below, the mounting device 112 is preferably centered on the helmet assembly 12 relative to the facial opening 42. Preferably, the mounting device 112 is a single mounting clip 114 connected to the helmet assembly 12 and that is positioned, preferably centered, relative to the facial opening 42. Of course, it is to be understood that the mounting device 112 can alternatively include more than one mounting clip 114. For example, the mounting device 112 can be defined to include two, three, four, etc. mounting clips 114. In such cases, the helmet assembly 12 will include a corresponding number of mounting mechanisms 108, preferably apertures 110. As an example, if the mounting device 112 is defined to include two mounting clips 114, then the mounting device 112, including the two mounting clips 114, is still considered centered relative to the facial opening 42 even though one of the two mounting clips 114 is disposed on the right-center, and the other of the two mounting clips 114 is disposed on the left-center. As implied above, it is not necessary that the mounting mechanism 108 and the mounting device 112 be centered. Instead, all that is required is that the mounting mechanism 108 and the mounting device 112 'function' to automatically center the face shield 96 over the facial opening 42 as the user is self-gowning. In other words, both the mounting mechanism 108 and the mounting device 112 can be 'off-center' and so long as the two 108, 112 align with one another during self-gowning, then the face shield 96 and the attached gown 88 will be automatically centered over the facial opening 42 of the helmet assembly 12.

As best shown in FIG. 3, the mounting clip 114 extends upwardly from the base section 32 away from the facial opening 42 of the helmet assembly 12 to support the face shield 96. The mounting clip 114 includes a distal edge 116 extending outwardly from the base section 32 such that a portion 118 of the face shield 96 rests between the distal edge 116 and the base section 32 after the face shield 96 is mounted to the mounting clip 114 to support the gown 88. Preferably, as the face shield 96 is mounted to the mounting clip 114, the mounting clip supports an entire weight of the gown 88.

The mounting clip 114 interlocks with the aperture 110 that is, in the preferred embodiment, centered on the face shield 96 to automatically center the face shield 96 over the facial opening 42. More specifically, the mounting clip 114 protrudes through the aperture 110. As discussed above, the mounting clip 114 preferably also supports an entire weight of the gown 88 and the face shield 96 to assist the single user is self-gowning while maintaining a relative position between the gown 88 and face shield 96 and the helmet assembly 12. Therefore, after the user places his or her arms partially into the sleeves of the gown 88, the user can self-gown by simply hanging the face shield 96, including the aperture 110, and the head 14 portion on the mounting clip 114. Because the mounting clip 114 and the aperture 110 are in the centered relationships as described above, the face shield 96 is automatically centered relative to the facial section 40 and the facial opening 42 of the helmet assembly 12, and there is no need for the user to repeatedly adjust the face shield 96. Instead, the user simply brings or 'rolls' the head portion 92 of the gown 88 over the helmet assembly 12 while maintaining sterility all the while. The gown 88 then drapes completely over the helmet assembly 12 and the user's body 16. This is a simple process for the user because the mounting clip 114 is also supporting the weight of the face shield 96 and head portion 92 of the gown 88. As such, the user is not required to support the face shield 96 and the head portion 92 of the gown 88 as they bring the head portion 92 over the helmet assembly 12. As described above, the positioning and supporting system 106 allows the user, such as a surgeon, to dress into the helmet assembly 12 and surgical gown 88 without the need for an assistant.

Alternatively, the subject invention can include a visual positioning system, disclosed by first 107 and second 109 visual indicators in FIGS. 9 and 3, respectively. Although the visual positioning system of the subject invention does assist the single user in self-gowning while maintaining sterility, the visual positioning system is different from the positioning and supporting system, as described above, because the visual positioning system does not support the weight of the gown 88 as the single user is self-gowning. Instead, the visual positioning system includes the first visual indicator 107 (refer to FIG. 9) disposed on the face shield 96 which enables the user to visually align the face shield with the helmet assembly. The first visual indicator 107 is a marker or other suitable visual indicator for the user to look at as he or she is self-gowning. The visual positioning system also includes a second visual indicator 109 (refer to FIG. 3) that compliments the first visual indicator 107. More specifically, the second visual indicator 109 is a marker or other suitable visual indicator that is positioned relative to the facial opening 42 of the helmet assembly 12 for alignment with the first visual indicator 107 on the face shield 96. As such, the visual positioning system, including the first 107 and second 109 visual indicators, automatically centers the face shield 96 over the facial opening thereby assisting the single user is self-gowning while maintaining the relative position between the gown and face shield and the helmet assembly while maintaining sterility.

Although not required for overall centering, the first 107 and second 109 visual indicators are preferably centered on the face shield 96 and on the helmet assembly 12, respectively. Furthermore, the second 109 visual indicator is preferably disposed on either one of the inner and outer shells 18, 20 of the helmet assembly 12 in a suitable location for the user's eyes to pick up or notice as he or she is self-gowning.

To maintain a constant volume of air flowing into the air filtration system 10 during or throughout the entire use of the air filtration system 10 by the user, the subject invention includes a method. The method includes the step of selectively activating and deactivating the power supply 90 at an activation rate, i.e., a first activation rate. This step distributes a required voltage to the motor 52 thereby establishing a rotational speed (RPMs) for the fan 50 that correlates to the constant volume of air flowing into the air filtration system 10. The back electromotive force (back EMF) of the motor 52 is monitored by the controller 118 to determine the rotational speed of the fan 50 as well as when the RPMs of the fan 50 have stabilized, i.e., maintained constant RPMs for a predetermined period of time (e.g. 10 seconds). After the rotational speed of the fan 50 has stabilized for the predetermined period of time, and optionally once the user has not manipulated motor controls for the predetermined period of time, whatever this period of time is, the controller 118 then monitors the voltage of the power supply 70. As the voltage of the power supply decreases, which inevitably occurs, the power supply 70 is selectively activated and deactivated at a second activation rate, which is higher than the first activation rate, to sustain the required voltage being distributed to the motor 52. As such, the constant RPMs for the motor 52 and the constant volume of air flowing into air filtration system 10 is maintained. The selective activation and deactivation of the power supply 70 is known in the art as pulse width modulation or PWM and a specific example this method is set forth in greater detail below.

In addition to controlling the volume of air flowing into the air filtration system 10, the subject invention also provides for audible indication of a minimum and a maximum volume of air to the user such that the user recognizes when the minimum and maximum volumes have been achieved. The ultimate object is to obtain constant air flow throughout the air filtration system 10 and helmet assembly 12. To accomplish this, the subject invention incorporates a controller 118 that selectively activates and deactivates the power supply 70 at the activation rate. This activation rate has a frequency that is audible to the user for providing audible indication of the minimum and the maximum volume of air to the user. That is, the subject invention provides the user with an audible 'ping' upon reaching the minimum and maximum volumes of air flowing into the helmet assembly 12.

The frequency at which the controller 118 selectively activates and deactivates the power supply 70 when the minimum and maximum volumes of air are flowing into the air filtration system 10 and helmet assembly 12 is preferably 1 kHz. However, it is to be understood that the frequency may otherwise be within the acceptable range of unaided human hearing (30 Hz–20 kHz) so long as it provides the audible indication. The frequency of the activation rate causes various components of the motor 52 of the fan module 46 to vibrate at the frequency thereby generating the audible indication.

More specifically, the air filtration system 10 and helmet assembly 12 include first 120 and second 122 motor controls that extend from the outer wall 62 of the scroll housing 48, through an opening in the helmet assembly 12, and then from the outer shell 20 of the helmet assembly 12. The motor controls 120, 122 are electronically connected to the controller 118. The motor controls 120, 122 respond to manipulation by the user for increasing or decreasing the rotational speed of the fan 50. As described above, the rotational speed of the fan 50 correlates to the volume of air flowing into the air flow channel 26. Therefore, increasing or decreasing the rotational speed of the fan 50 adjusts the volume of air flowing into the air flow channel 26. The first motor control 120 is responsive to manipulation by the user to increase the rotational speed of the fan 50 and therefore to increase the volume of air flowing into the air flow channel 26. The second motor control 122 is responsive to manipulation by the user to decrease the rotational speed of the fan 50 and therefore to decrease the volume of air flowing into the air flow channel 26. Of course, an opposite set-up of the first and second motor controls 120, 122 could be established.

Figure 10:
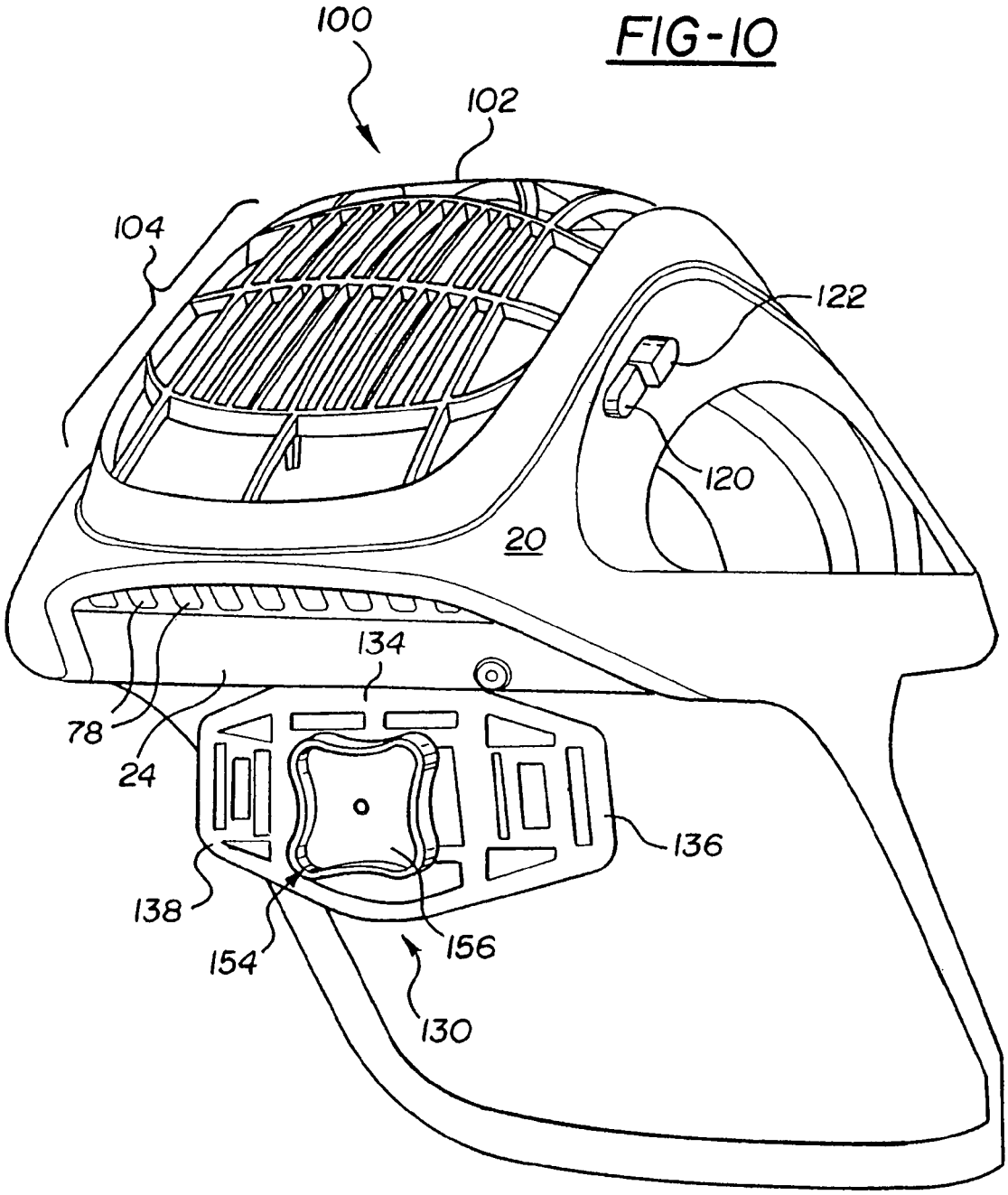
FIG. 10 is a perspective view from a rear of the helmet assembly illustrating an intake grid and first and second motor controls extending at different heights from an outer shell of the helmet assembly.
Figure 11:
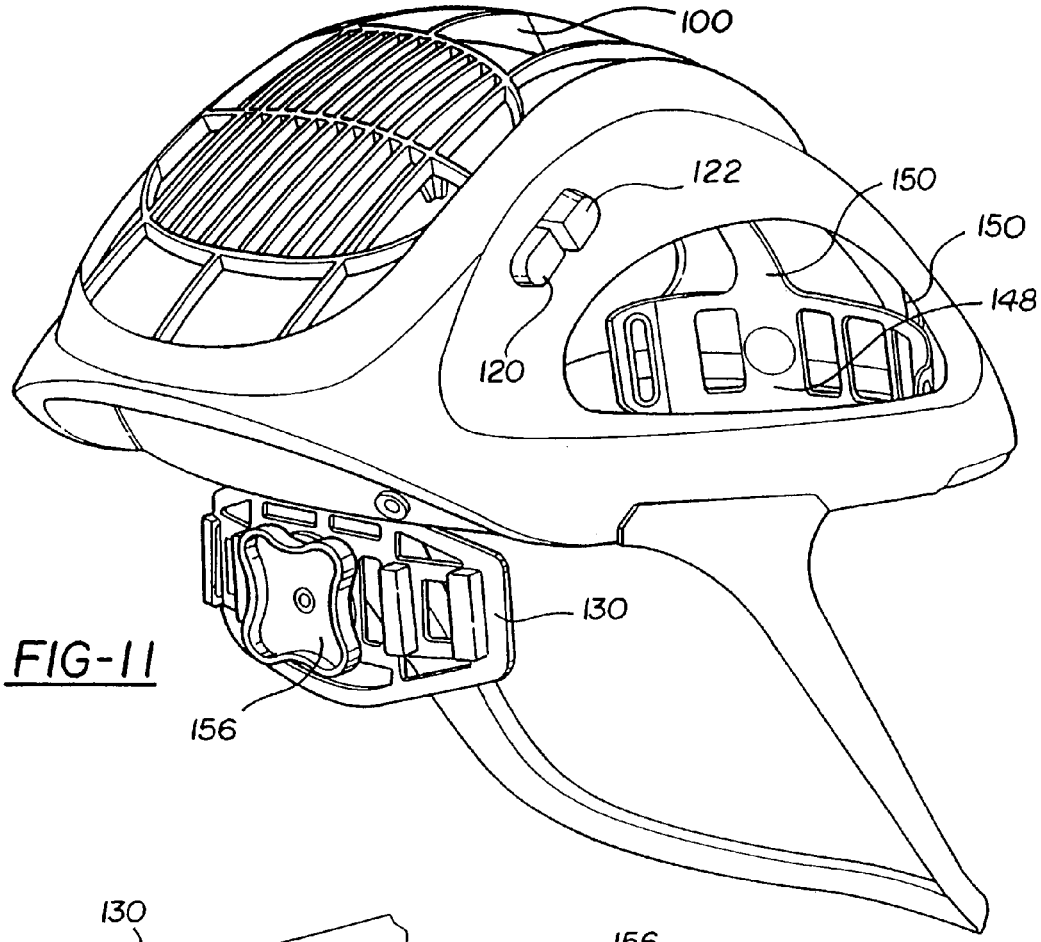
FIG. 11 is a perspective view from the rear of the helmet assembly illustrating a rear support, strap, and adjustment knob to facilitate a proper fit of the helmet assembly on various sized heads of users.
Figure 12:
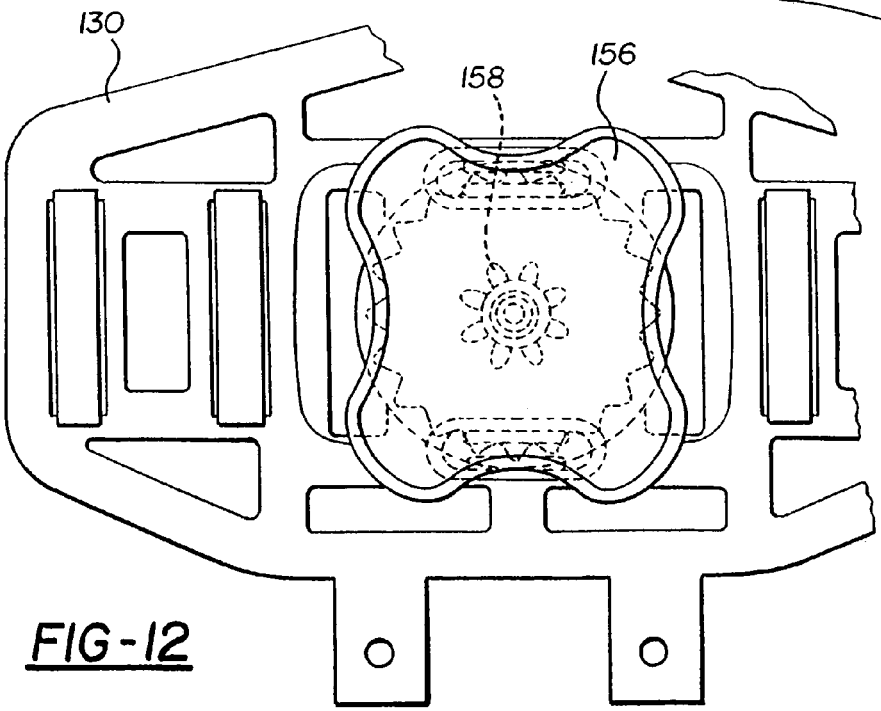
FIG. 12 is an enlarged view of the rear support and the adjustment knob.
Figure 13:
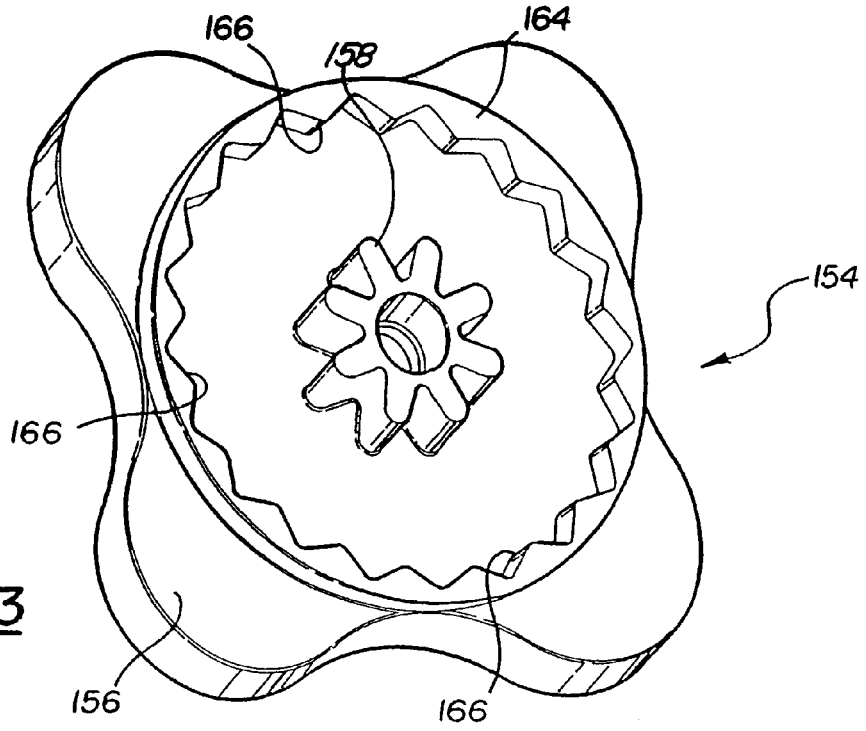
FIG. 13 is an enlarged perspective view of an inner surface of the adjustment knob illustrating a pinion and a plurality of teeth.

As shown in the Figures, the first and second motor controls 120, 122 are preferably first and second push-buttons. As shown in FIG. 10, the first and second push-buttons extend from the outer shell 20 at a height that varies from the other of the first and second push-buttons to assist the user, without looking, in manipulating the push-buttons to increase or decrease the speed of the fan 50 and the volume of air. While the user is wearing the helmet assembly 12 and is dressed into the air filtration system 10, he or she can recognize 'by touch' that the height of the push-buttons varies. This facilitates ease of operation in increasing and decreasing the volume of air flowing into the air flow channel 26.

The plurality of rotational speeds at which the air filtration system 10 and helmet assembly 12 drive the fan 50 is defined to included a first rotational speed correlating to a first volume of air, a second rotational speed correlating to a second volume of air, a third rotational speed correlating to a third volume of air, a penultimate rotational speed correlating to a penultimate volume of air, and a last rotational speed correlating to a last volume of air. However, in the preferred embodiment of the subject invention, the plurality of rotational speeds at which the air filtration system 10 and helmet assembly 12 drives the fan 50 is further defined to include five distinct rotational speeds for driving the fan 50. It is to be understood that the subject invention may include any number of distinct rotational speeds for driving the fan 50 without varying the scope of the subject invention. In the preferred embodiment as set forth above, each of the five rotational speeds for driving the fan 50 correlate to a particular volume of air flowing into the air flow channel 26. For instance, there is a first rotational speed correlating to a first volume of air, a second rotational speed correlating to a second volume of air, and so on up to a fifth rotational speed correlating to a fifth volume of air. For descriptive purposes only, the first volume of air is the minimum volume of air flowing into the air flow channel 26, and the fifth volume of air is the maximum volume of air flowing into the air flow channel 26. However, it is to be understood that the opposite may be true. That is, the first volume of air may be the maximum volume of air, and the fifth volume of air may be the minimum volume of air.

In the preferred embodiment of the subject invention, the frequency of the activation rate is audible only in certain instances. Specifically, the frequency of the activation rate is only audible when the user manipulates the first motor control 120 to increase the rotational speed of the fan 50 from the fourth rotational speed to the fifth rotational speed of the fan 50, and when the user manipulates the second motor control 122 to decrease the rotational speed of the fan 50 from the second rotational speed to the first rotational speed of the fan 50.

As briefly discussed above, the power supply 70 powers the motor 52 through PWM. It is understood in the art that in PWM, the controller 118 instructs a switch to selectively activate and deactivate the power supply 70 through pulse width modulation. This ON (activated)/OFF (deactivated) scenario controls the RPMs of the fan 50. As an illustrative example, at the fifth rotational speed of the fan 50, the fan 50 rotates at 3800 RPM. To establish the 3800 RPM, the controller 118 selectively activates and deactivates the power supply 70 in a 70:30 ratio. That is, the controller 118 turns the power supply 70 ON 70% of the time and OFF 30% of the time. At the fourth rotational speed of the fan 50, the fan 50 rotates at 3350 RPM. To establish the 3350 RPM, the controller 118 selectively activates and deactivates the power supply 70 in a 60:40 ratio. That is, the controller 118 turns the power supply 70 ON 60% of the time and OFF 40% of the time. At the third rotational speed of the fan 50, the fan 50 rotates at 2900 RPM. To establish the 2900 RPM, the controller 118 selectively activates and deactivates the power supply 70 in a 50:50 ratio. That is, the controller 118 turns the power supply 70 ON 50% of the time and OFF 50% of the time. At the second rotational speed of the fan 50, the fan 50 rotates at 2450 RPM. To establish the 2450 RPM, the controller 118 selectively activates and deactivates the power supply 70 in a 40:60 ratio. That is, the controller 118 turns the power supply 70 ON 40% of the time and OFF 60% of the time. Finally, in the illustrative example, at the first rotational speed of the fan 50, the fan 50 rotates at 2000 RPM. To establish the 2000 RPM, the controller 118 selectively activates and deactivates the power supply 70 in a 30:70 ratio. That is, the controller 118 turns the power supply 70 ON 30% of the time and OFF 70% of the time.

In terms of the illustrative example and the preferred embodiment, the controller 118 turns the power supply ON and OFF in the 70:30 ratio (the fifth and maximum volume of air) and in the 30:70 ratio (the first and minimum volume of air) at the audible rate of 1 kHz. On the other hand, in the other ratios, the controller 118 turns the power supply 70 ON and OFF at an inaudible rate, for example 25 kHz.

The above example is in no manner intended to limit the breadth of the present invention as set forth in the appended claims, but rather is provided to further illustrate the features and numerous advantages of the invention.

It is to be understood that, in the preferred embodiment of the subject invention, the controller 118 monitors the RPMs of the output 58 of the motor 52. More specifically, as set forth in the above method, the controller 118 monitors the voltage generated by the motor 52 to receive the RPM information of the output 58 of the motor 52. The controller 118 then converts the information from analog to digital simply by changing the voltage generated by the motor 52 into a digital value representative of the voltage. The controller 118 incorporated into the subject invention also recognizes a set point that is indicative of one of the plurality of rotational speeds of the fan 50. It is to be understood that the set point is indicative of the current rotational speed of the fan 50. As such, a memory is included into the controller 118 for retaining the set point, i.e., the last rotational speed of the fan 50, when the power supply 70 is deactivated. The power supply 70 is deactivated either when the voltage in the power supply 70 drops to zero or the power supply 70 is disconnected and replaced. In other words, if the battery drains, or is disconnected for any reason, then a new battery can be used, and once connected the controller 118 will control the power supply 70 to rotate the fan 50 at the last set point. It is understood that users may use the helmet assembly 12 over a period of time that is longer than the life of the battery, and that once the voltage of the battery drops below a useful value, the batter is replaced with a new battery. As such, when the new, i.e., fully charged, battery is installed, the controller 118 read the available voltage of the battery and instructs the switch to adjust, through PWM, the ON/OFF ratio to the motor 52 to maintain the predetermined air flow throughout the helmet assembly 12 that is established by the set point.

To assist in minimizing the strain on the head 14 and the neck of the user, the air filtration system 10 and helmet assembly 12 of the subject invention include a front-adjustable support 128 for the helmet assembly 12. Strain and torque on the head 14 and neck of the user is minimized by maintaining the weight of the fan 50 and motor 52 over the neck of the user even upon adjustment of the helmet assembly 12 to fit various sized heads. The front-adjustable support 128 includes a rear support 130 that rigidly extends from the rear section 36 of the base section 32. It is to be understood that the rear support 130 can be a separate part that is connected to the helmet assembly 12 or can be an integral part of the helmet assembly 12. The rear support 130 includes first and second rigid connectors 132 that connect the rear support 130 to the rear section 36. In the preferred embodiment, the rear support 130 is connected to and extends from the rear section 36 of the inner shell 18 and will described below in terms of the inner shell 18. However, it is to be understood that the rear support 130 can connect to and extend from the rear section 36 of the outer shell 20 without varying the scope of the subject invention.

Referring to FIGS. 10 through 14, an adjustment segment 134 having first 136 and second 138 sides is disclosed. Although not required, the rear support 130 preferably includes the adjustment segment 134. That is, preferably the adjustment segment 134 is integral to, or the same part as, the rear support 130. However, the adjustment segment 134 can alternatively be a discrete component that is simply mounted to the rear support 130. In either situation, the adjustment segment 134 defines an adjustment aperture 140. The subject invention also includes a strap 142 flexibly connected to and extending from the front section 34 of the inner shell 18. The strap 142 includes a first end 144 disposed within the first side 136 of the adjustment segment 134, and a second end 146 disposed within the second side 138 of the adjustment segment 134. More specifically, the adjustment aperture 140 defined by the adjustment segment 134 receives the first and second ends 144, 146 of the strap 142. Preferably, the first end 144 is movably disposed within the first side 136 of the adjustment segment 134, and preferably the second end 146 is movably disposed within the second side 138 of the adjustment segment 134. However, as will be understood from the explanation below, the first end 144 may be movably disposed within the first side 136 of the adjustment segment 134 and the second end 146 may be fixedly disposed within the second side 138 of the adjustment segment 134. Alternatively, the first end 144 may be fixedly disposed within the first side 136 of the adjustment segment 134 and the second end 146 may be movably disposed within the second side 138 of the adjustment segment 134.

The strap 142 further includes a frontal portion 148 disposed between its first and second ends 144, 146 and opposite the adjustment segment 134 of the rear support 130. At least one hinge 150 extends from the frontal portion 148 of the strap 142 to flexibly connect the strap 142 to the front section 34 of the inner shell 18. Preferably, there are two hinges 150 that extend from the frontal portion 148 of the strap 142. In such a case, the two hinges 150 are connected to the front section 34 of the inner shell 18 and to the frontal portion 148 of the strap 142 equidistant from one another. A gap 152 exists between the frontal portion 148 of the strap 142 and the front section 34 of the inner shell 18.

An adjustment device 154 is mounted to the adjustment segment 134 of the rear support 130. The adjustment device 154 is manipulated to pull the strap 142 from the front section 34 of the inner shell 18 to maintain the weight of the fan 50 and motor 52 over the user's neck. This will described below. Referring to FIGS. 10 through 14, the adjustment device 154 is further defined as an adjustment knob 156. The adjustment knob 156 is rotatably mounted from and extends into the adjustment aperture 140 of the rear support 130 to engage the first and second ends 144, 146 of the strap 142. The adjustment knob 156 includes a pinion 158 extending into the adjustment aperture 140. Further, the first end 144 of the strap 142 includes a first rack 160 and the second end 146 of the strap 142 includes a second rack 162. The pinion 158 of the adjustment knob 156 extends into the adjustment aperture 140 to engage and move the first and second racks 160, 162 upon rotation of the adjustment knob 156.

The adjustment device 154 engages the first and second ends 144, 146 of the strap 142 to manipulate the first and second ends 144, 146 toward each other. This tightens the strap 142 and pulls the strap 142 from the front section 34 as the rear support 130 remains fixed relative to both the rear section 36 and the strap 142. The adjustment device 154 also engages the first and second ends 144, 146 of the strap 142 to manipulate the first and second ends 144, 146 away from each other. This loosens the strap 142 and pushes the strap 142 toward the front section 34 as the rear support 130 remains fixed relative to both the rear section 36 and the strap 142.

It is to be understood that all that is required is that the adjustment device 154 function to manipulate the first and second ends 144, 146 toward each other to tighten the strap 142 or away from each other to loosen the strap 142. To manipulate the first and second ends 144, 146 toward each other in the preferred embodiment, both the first and second ends 144, 146 can move toward each other. Alternatively, the subject invention may be 'single-end adjustable.' That is, it is also possible for the first and second ends to be manipulated toward each other even if the first end 144 is fixed and the second end 146 is the only end of the strap 142 that is manipulated, i.e., moved, by the adjustment device 154, or even if the second end 146 is fixed and the first end 144 is the only end of the strap 142 that is manipulated, i.e., moved, by the adjustment device 154.

In operation, as the strap 142 is tightened by the adjustment device 154, the hinges 150 flex to increase the gap 152 between the frontal portion 148 of the strap 142 and the front section 34 of the inner shell 18. Because the strap 142 only moves relative to the front section 34 of the inner shell 18, the weight of the fan module 46 and scroll housing 48 is maintained over the neck of the user when the helmet assembly 12 is adjusted to fit a smaller sized head 14. Alternatively, if the strap 142 is loosened, the hinges 150 relax to decrease the gap 152. As such, the weight of the fan module 46 and scroll housing 48 is maintained over the neck of the user when the helmet assembly 12 is adjusted to fit a larger sized head 14. In a sense, the helmet assembly 12 remains stationary relative to the user's head 14 and neck upon adjustment, only the strap 142 moves within the helmet assembly 12.

Figure 14:
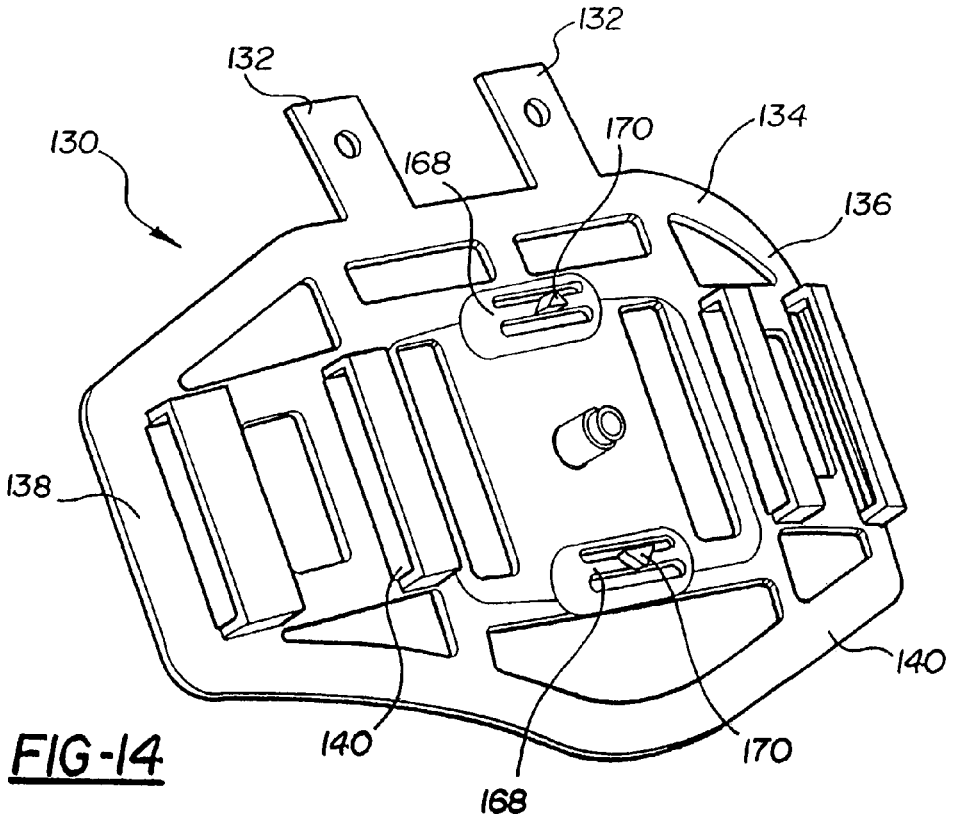
FIG. 14 is an enlarged perspective view of the rear support illustrating a flexible support bar and a detent that mates with the plurality of teeth on the adjustment knob.

The adjustment knob 156 additionally includes an inner surface 164 facing the rear support 130 of the helmet assembly 12. The inner surface 164 includes a plurality of teeth 166. The teeth 166 form a ring around the inner surface 164. A flexible support bar 168 is molded into and extends from the rear support 130. The flexible support bar 168 includes at least one locking detent 170 mating with the teeth 166 of the adjustment knob 156 to lock the strap 142 relative to the rear support 130. Of course, more than one detent 170 can be utilized. As shown in FIG. 14, the preferred embodiment of the subject invention includes two flexible support bars 168 to lock the strap 142 relative to the rear support 130. In operation, the flexible support bars 168 flex to disengage the detent 170 from the teeth 166 of the adjustment knob 156 upon manipulation of the adjustment knob 156 such that the strap 142 is allowed to move relative to the rear support 130. The flexible support bars 168 act like a spring and rebound to force the detent 170 back into engagement with the teeth 166.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that reference numerals are merely for convenience and are not to be in any way limiting, the invention may be practiced otherwise than as specifically described.

What is claimed is:

1. A helmet assembly of an air filtration system for mounting to a head of a user to distribute air about the head of the user, said assembly comprising:

an inner structural shell;

an outer structural shell spaced from said inner structural shell along at least a portion thereof to define at least one air flow channel between said inner and outer shells for channeling air about the head of the user; and a fan module mounted to at least one of said inner and outer shells and including at least one air inlet and at least two air outlets, said fan module drawing air into said at least one air inlet and distributing air out through said at least two air outlets and into said air flow channel for distributing air about the head of the user.

2. An assembly as set forth in claim 1 including a scroll housing mounted adjacent said fan module wherein said scroll housing further includes a base portion and an outer wall circumferentially extending around said base portion.

3. An assembly as set forth in claim 2 wherein said outer wall of said scroll housing is partitioned to define said at least two air outlets.

4. An assembly as set forth in claim 3 further including a base section having a front section and a rear section, and a facial section extending from said base section to define a facial opening.

5. An assembly as set forth in claim 4 wherein said inner and outer shells extend between said front and rear sections of said base section to define said air flow channel.

6. An assembly as set forth in claim 5 further including a front air exit disposed at said front section of said base section for distributing air from said air flow channel toward a front of the head of the user, and a rear air exit disposed at said rear section of said base section for distributing air from said air flow channel toward a back of the head of the user.

7. An assembly as set forth in claim 6 wherein said at least two air outlets are in fluid communication with said front and rear air exits to distribute air toward the front and back of the head of the user, respectively.

8. An assembly as set forth in claim 7 wherein said inner and outer shells converge toward said front section of said base section to define said front air exit.

9. An assembly as set forth in claim 8 further including an air deflection angle defined by said outer shell angling toward said inner shell at said front air exit for proper deflection of air toward the front of the head of the user.

10. An assembly as set forth in claim 9 wherein said air deflection angle is from 0 to 90 degrees.

11. An assembly as set forth in claim 9 wherein said air deflection angle is from 25 to 35 degrees.

12. An assembly as set forth in claim 4 further including an intake grid mounted to said outer shell, said intake grid adapted for use with a gown that covers said base section and operates as a filter medium to filter air drawn into said fan module.

13. An assembly as set forth in claim 12 wherein said intake grid further includes a top surface spaced from said outer shell for retaining the filter medium away from said outer shell and said fan module.

14. An assembly as set forth in claim 13 wherein said intake grid is contoured to said outer shell between said front section and said rear section of said base section to maximize an effective intake area for the filter medium to filter air drawn into said fan module.

15. An assembly as set forth in claim 14 further including dissipation cavities disposed at opposite lateral sides of said inner and outer shells, said cavities providing for increased air release from said air flow channel and from the user out through the filter medium.

16. An assembly as set forth in claim 6 wherein said inner shell further includes a cover surface and a rear facing, said cover surface and said rear facing extending to said outer shell at said rear section of said base section.

17. An assembly as set forth in claim 16 wherein said rear air exit is formed within said rear facing for distributing air from said air flow channel toward the back of the head of the user.

18. An assembly as set forth in claim 16 further including a mounting cavity between said cover surface and said outer shell at said rear section of said base section.

19. An assembly as set forth in claim 18 wherein said fan module is disposed within said mounting cavity at said rear section to minimize strain on the head and neck of the user.

20. An assembly as set forth in claim 19 wherein said fan module includes a fan for drawing air into said at least one air inlet, and a motor for rotating said fan.

21. An assembly as set forth in claim 20 further including a power supply powering said motor to rotate said fan.

22. An assembly as set forth in claim 21 wherein said power supply powers said motor through pulse width modulation.

23. An assembly as set forth in claim 20 wherein said fan is rotatably mounted to said base portion of said scroll housing within said outer wall for said fan to draw air into said at least one air inlet.

24. An assembly as set forth in claim 23 wherein said at least one air inlet is formed within said outer shell for drawing air into said fan module.

25. An assembly as set forth in claim 24 further including a support pedestal protruding from said base portion, said fan rotatably mounted on said support pedestal to draw air into said at least one air inlet.

26. An assembly as set forth in claim 25 wherein said motor is mounted within an underside of said support pedestal between said support pedestal and said cover surface of said inner shell.

27. An assembly as set forth in claim 12 wherein said facial section extending from said base section is further defined as a chin bar extending from said base section to define said facial opening and to maintain the gown away from the head of the user.

28. An assembly as set forth in claim 27 wherein said chin bar is flexible.

29. An assembly as set forth in claim 27 wherein said flexible chin bar is formed of plastic.

30. An assembly as set forth in claim 7 further including at least one air bleed valve disposed in said fan module to influence a volume of air flowing into said air flow channel from each of said at least two air outlets.

31. An assembly as set forth in claim 30 wherein said air bleed valve is mechanically controlled to manipulate the volume of air.

32. An assembly as set forth in claim 30 wherein said air bleed valve is electronically controlled to manipulate the volume of air.

33. An assembly as set forth in claim 1 wherein said inner and outer structural shells form said air flow channel from a two-sheet thermoforming process.

34. An assembly as set forth in claim 33 wherein each of said inner and outer structural shells include an outer periphery, said inner and outer shells being pinched together at said outer peripheries.

35. An assembly as set forth in claim 34 wherein said air flow channel is thermoformed between said pinched outer peripheries of said inner and outer shells.

36. An air filtration system for filtering air between a head and body of a user and an environment external to the user, said air filtration system comprising:

a helmet assembly adapted to be mounted on the head of the user and including a base section and a facial section, said base section of said helmet assembly further including an inner structural shell and an outer structural shell spaced from said inner structural shell to define at least one air flow channel between said inner and outer shells for channeling the air about the head of the user;

a gown including a body portion for covering at least a portion of the user and a head portion for covering said base section of said helmet assembly, said head portion of said gown operating at least partially as a filter medium to filter air between the user and the external environment; and a fan module mounted to at least one of said inner and outer shells and including at least one air inlet and at least two air outlets, said fan module drawing air in through said at least one air inlet and distributing the air out through said at least two air outlets into said at least one air flow channel for distributing air about the head of the user.

37. An air filtration system for filtering air between a head and body of a user and an environment external to the user, said air filtration system comprising:

a helmet assembly including an inner structural shell and an outer structural shell spaced from said inner structural shell along at least a portion thereof to define at least one air flow channel between said inner and outer shells for channeling the air about the head of the user;

a gown including a body portion for covering at least a portion of the body of the user and a head portion for covering at least a portion of said helmet assembly, said head portion of said gown operating at least partially as a filter medium to filter air between the user and the external environment;

a face shield mounted to said head portion of said gown to permit the user to view through said head portion of said gown; and a fan module mounted to at least one of said inner and outer shells of said helmet assembly and including at least one air inlet and at least two air outlets, said fan module drawing air into said at least one air inlet and distributing the air out through said at least two air outlets and into said air flow channel for distributing air about the head of the user.

38. A system as set forth in claim 37 wherein said fan module includes a fan for drawing air into said air inlet, and a motor for rotating said fan.

39. A system as set forth in claim 38 further including a power supply powering said motor to rotate said fan.

40. A system as set forth in claim 39 wherein said power supply powers said motor through pulse width modulation.

41. A system as set forth in claim 37 wherein said helmet assembly includes a base section and a facial section and said base section includes a front section and a rear section with said facial section extending from said base section to define a facial opening.

42. A system as set forth in claim 41 wherein said face shield is mounted to said head portion of said gown to cover said facial opening to permit the user to view through said head portion of said gown and said facial opening of said helmet assembly.

43. A system as set forth in claim 41 further including a mounting cavity between said inner shell and said outer shell at said rear section of said base section.

44. A system as set forth in claim 43 wherein said fan module is disposed within said mounting cavity at said rear section to minimize strain on the head and neck of the user.

45. A system as set forth in claim 37 further including an intake grid mounted to said outer shell such that said gown covers said intake grid to operate as said filter medium for filtering air drawn into said fan module.

46. A system as set forth in claim 45 wherein said intake grid further includes a top surface spaced from said outer shell for retaining said filter medium away from said outer shell.

47. A system as set forth in claim 46 wherein said intake grid is contoured to said outer shell between said front section and said rear section of said base section to maximize an effective intake area for said filter medium to filter air drawn into said fan module.

48. A helmet assembly of an air filtration system for mounting to a head of a user to minimize strain on the head and neck of the user, said assembly comprising:

a structural shell having a front section and a rear section;

a rear support rigidly extending from said rear section of said structural shell such that said rear support is fixed from substantial movement relative to said rear section;

a strap supported by said rear support and including a first end and a second end; and an adjustment device engaging said first and second ends of said strap to manipulate said first and second ends toward each other to tighten said strap and to pull said strap from said front section as said rear support remains fixed relative to said rear section and said strap, and to manipulate said first and second ends away from each other to loosen said strap and to push said strap toward said front section as said rear support remains fixed relative to said rear section and said strap.

49. An assembly as set forth in claim 48 further including an adjustment segment having first and second sides wherein said first end of said strap is movably disposed within said first side of said adjustment segment and said second end of said strap is fixedly disposed within said second side of said adjustment segment.

50. An assembly as set forth in claim 48 further including an adjustment segment having first and second sides wherein said first end of said strap is fixedly disposed within said first side of said adjustment segment and said second end of said strap is movably disposed within said second side of said adjustment segment.

51. An assembly as set forth in claim 48 further including an adjustment segment having first and second sides wherein said first end of said strap is movably disposed within said first side of said adjustment segment and said second end of said strap is movably disposed within said second side of said adjustment segment.

52. An assembly as set forth in claim 48 further including an adjustment segment having first and second sides wherein said adjustment segment is fixed from movement relative to said structural shell and said rear support and said adjustment device is mounted to said adjustment segment.

53. An assembly as set forth in claim 52 wherein said strap further includes a frontal portion disposed between said first and second ends and opposite said adjustment segment.

54. An assembly as set forth in claim 53 further including at least one hinge extending from said frontal portion of said strap to flexibly connect said strap to said front section of said structural shell.

55. An assembly as set forth in claim 54 further including a gap defined between said frontal portion of said strap and said front section of said structural shell.

56. An assembly as set forth in claim 55 wherein said at least one hinge flexes to increase said gap as said strap is tightened by said adjustment device.

57. An assembly as set forth in claim 56 wherein said at least one hinge relaxes to decrease said gap as said strap is loosened by said adjustment device.

58. An assembly as set forth in claim 48 further including an adjustment segment disposed on said rear support wherein said rear support integrally includes said adjustment segment and said adjustment device is mounted to said adjustment segment.

59. An assembly as set forth in claim 48 further including an adjustment segment disposed on said rear support wherein said adjustment segment defines an adjustment aperture that receives said first and second ends of said strap.

60. An assembly as set forth in claim 59 wherein said adjustment device is further defined as an adjustment knob rotatably mounted from and extending into said adjustment aperture to engage said first and second ends of said strap.

61. An assembly as set forth in claim 60 wherein said adjustment knob includes a pinion extending into said adjustment aperture.

62. An assembly as set forth in claim 61 wherein said first end of said strap includes a first rack and said second end of said strap includes a second rack, said pinion of said adjustment knob extending into said adjustment aperture to engage said first and second racks upon rotation of said adjustment knob.

63. An assembly as set forth in claim 62 wherein said adjustment knob further includes an inner surface facing said rear support, said inner surface including a plurality of teeth.

64. An assembly as set forth in claim 63 further including a flexible support bar extending from said rear support, said support bar including at least one locking detent mating with said teeth of said adjustment knob to lock said strap relative to said rear support.

65. An assembly as set forth in claim 64 wherein said flexible support bar flexes to disengage said detent from said teeth of said adjustment knob upon manipulation of said adjustment knob such that said strap is allowed to move relative to said support.

66. An assembly as set forth in claim 48 further including a fan module disposed adjacent said rear section of said structural shell.

67. An air filtration system for filtering air between a user and an environment external to the user and for minimizing strain on a head and neck of the user, said air filtration system comprising:

a helmet assembly including a structural shell having a front section and a rear section;

a gown including a body portion for covering at least a portion of the body of the user and a head portion for covering at least a portion of said helmet assembly, said head portion of said gown operating at least partially as a filter medium to filter air between the user and the external environment;

a face shield mounted to said head portion of said gown to cover a section of said helmet assembly thereby permitting the user to view through said head portion of said gown;

a rear support rigidly extending from said rear section of said structural shell;

a strap supported by said rear support and flexibly connected to and extending from said front section of said structural shell, said strap including a first end disposed within said first side of said adjustment segment, and a second end disposed within said second side of said adjustment segment; and an adjustment device engaging said first and second ends of said strap to manipulate said first and second ends toward each other to tighten said strap and to pull said strap from said front section as said rear support remains fixed relative to said rear section and said strap, and to manipulate said first and second ends away from each other to loosen said strap and to push said strap toward said front section as said rear support remains fixed relative to said rear section and said strap.

68. A system as set forth in claim 67 further including an adjustment segment having first and second sides wherein said first end of said strap is movably disposed within said first side of said adjustment segment and said second end of said strap is fixedly disposed within said second side of said adjustment segment.

69. A system as set forth in claim 67 further including an adjustment segment having first and second sides wherein said first end of said strap is fixedly disposed within said first side of said adjustment segment and said second end of said strap is movably disposed within said second side of said adjustment segment.

70. A system as set forth in claim 67 further including an adjustment segment having first and second sides wherein said first end of said strap is movably disposed within said first side of said adjustment segment and said second end of said strap is movably disposed within said second side of said adjustment segment.

71. A system as set forth in claim 67 further including an adjustment segment disposed on said rear support wherein said adjustment segment is fixed from movement relative to said structural shell and said rear support and said adjustment device is mounted to said adjustment segment.

72. A system as set forth in claim 67 further including an adjustment segment disposed on said rear support wherein said rear support integrally includes said adjustment segment and said adjustment device is mounted to said adjustment segment.

73. A helmet assembly of an air filtration system for mounting to a head of a user to distribute air about the head of the user, said assembly comprising:

an inner structural shell;

an outer structural shell spaced from said inner structural shell along at least a portion thereof to define at least one air flow channel between said inner and outer shells for channeling air about the head of the user;

at least one helmet air exit for distributing air from said air flow channel toward the head of the user; and a fan module mounted to at least one of said inner and outer shells and including at least one air inlet and at least two air outlets, said fan module drawing air in through said at least one air inlet and distributing the air out through said at least two air outlets into said air flow channel and to said at least one helmet air exit.

74. An assembly as set forth in claim 73 further including a base section having a front section and a rear section.

75. An assembly as set forth in claim 74 wherein said at least one helmet air exit is further defined as first and second helmet air exits.

76. An assembly as set forth in claim 75 wherein said first helmet air exit is disposed at said front section of said base section for distributing air from said air flow channel toward a front of the head of the user, and said second helmet air exit is disposed at said rear section of said base section for distributing air from said air flow channel toward a back of the head of the user.

* * * * *